US010569586B2

(12) United States Patent
Toyama et al.

(10) Patent No.: US 10,569,586 B2
(45) Date of Patent: Feb. 25, 2020

(54) INK JET RECORDING APPARATUS

(71) Applicant: CANON KABUSHIKI KAISHA, Tokyo (JP)

(72) Inventors: Noboru Toyama, Kawasaki (JP); Toru Yamane, Yokohama (JP); Kyosuke Deguchi, Yokohama (JP); Ryosuke Hirokawa, Kawasaki (JP); Toru Ohnishi, Yokohama (JP); Akihiro Mouri, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/022,118

(22) Filed: Jun. 28, 2018

(65) Prior Publication Data

US 2018/0319188 A1 Nov. 8, 2018

Related U.S. Application Data

(63) Continuation of application No. PCT/JP2016/005246, filed on Dec. 28, 2016.

(30) Foreign Application Priority Data

Jan. 5, 2016 (JP) ..... 2016-000746
May 27, 2016 (JP) ..... 2016-106189

(51) Int. Cl.
*B41M 5/00* (2006.01)
*B41J 2/01* (2006.01)

(52) U.S. Cl.
CPC ..... *B41M 5/0011* (2013.01); *B41J 2/01* (2013.01)

(58) Field of Classification Search
CPC ..... B01D 53/228
(Continued)

(56) References Cited

U.S. PATENT DOCUMENTS 5,841,456 A 11/1998 Takei et al.
6,916,081 B2 7/2005 Nakashima
(Continued)

FOREIGN PATENT DOCUMENTS

CN 1990241 A 7/2007
CN 101332708 A 12/2008
(Continued)

OTHER PUBLICATIONS

First Office Action in Chinese Application No. 201680078084.8 (dated May 24, 2019).
(Continued)

*Primary Examiner* — Lam S Nguyen
(74) *Attorney, Agent, or Firm* — Venable LLP

(57) ABSTRACT

Disclosed is an ink jet recording apparatus including an image forming unit that forms a first image including a first liquid and a coloring material on an ink receiving medium; and a liquid absorbing member that includes a porous body which is configured to be brought into contact with the first image so as to absorb at least a portion of the first liquid from the first image, in which an average pore diameter of a first surface of the porous body which is configured to be brought into contact with the first image is equal to or smaller than 0.6 μm, an arithmetic average roughness Ra defined by JIS B 0601:2001 of the first surface of the porous body is equal to or smaller than 1.9 μm, an average pore diameter of a second surface, which is a back surface of the first surface, of the porous body is larger than the average pore diameter of the first surface, and a Gurley value defined by JIS P 8117 of the porous body is equal to or shorter than 10 seconds.

14 Claims, 7 Drawing Sheets

(58) Field of Classification Search
USPC ..... 347/105, 102
See application file for complete search history.

(56) References Cited

U.S. PATENT DOCUMENTS

| | | | | |
|---|---|---|---|---|
| 7,129,284 | B2 | 10/2006 | Ma et al. | |
| 7,422,318 | B2 | 9/2008 | Kadomatsu et al. | |
| 7,481,526 | B2 | 1/2009 | Inoue | |
| 7,497,564 | B2 | 3/2009 | Yui | |
| 7,556,342 | B2 | 7/2009 | Hamano | |
| 7,594,722 | B2 | 9/2009 | Kadomatsu et al. | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 8,226,225 | B2 | 7/2012 | Yamanobe | |
| 8,246,158 | B2 | 8/2012 | Ageishi et al. | |
| 8,857,962 | B2 | 10/2014 | Goto et al. | |
| 9,102,137 | B2 | 8/2015 | Koitabashi et al. | |
| 9,616,653 | B2 | 4/2017 | Liu | |
| 9,796,171 | B2 | 10/2017 | Liu | |
| 9,821,584 | B2 | 11/2017 | Noguchi et al. | |
| 10,029,481 | B2 | 7/2018 | Ohnishi et al. | |
| 2005/0212884 | A1* | 9/2005 | Ueki | B41J 11/0015 347/105 |
| 2006/0055755 | A1 | 3/2006 | Yui et al. | |
| 2006/0061642 | A1 | 3/2006 | Ueki | |
| 2006/0170752 | A1* | 8/2006 | Kadomatsu | B41J 2/2114 347/105 |
| 2006/0221166 | A1 | 10/2006 | Inoue | |
| 2007/0229586 | A1 | 10/2007 | Hirakawa | |
| 2008/0055356 | A1 | 3/2008 | Yamanobe | |
| 2008/0236480 | A1 | 10/2008 | Furukawa et al. | |
| 2009/0079784 | A1 | 3/2009 | Chiwata et al. | |
| 2011/0069109 | A1 | 3/2011 | Tojo | |
| 2015/0306539 | A1* | 10/2015 | Yamato | B01D 53/228 429/145 |
| 2018/0297377 | A1 | 10/2018 | Ohnishi et al. | |
| 2018/0304616 | A1 | 10/2018 | Honda et al. | |
| 2018/0304617 | A1 | 10/2018 | Ohnishi et al. | |
| 2018/0311951 | A1 | 11/2018 | Sakamoto et al. | |
| 2018/0319166 | A1 | 11/2018 | Yamane et al. | |
| 2018/0319179 | A1 | 11/2018 | Yamane et al. | |
| 2018/0319189 | A1 | 11/2018 | Ohnishi et al. | |
| 2018/0319190 | A1 | 11/2018 | Hirokawa et al. | |
| 2018/0326719 | A1 | 11/2018 | Masuda et al. | |
| 2018/0326755 | A1 | 11/2018 | Ohnishi et al. | |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| EP | 2 123 459 | A2 | 11/2009 |
| EP | 2 777 941 | A1 | 9/2014 |
| JP | 2000-103157 | A | 4/2000 |
| JP | 2001-171143 | A | 6/2001 |
| JP | 2001-179959 | A | 7/2001 |
| JP | 2004-43047 | A | 2/2004 |
| JP | 2004-181955 | A | 7/2004 |
| JP | 2005-161610 | A | 6/2005 |
| JP | 2006-82428 | A | 3/2006 |
| JP | 2006-88486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 1016559 | B2 | 12/2007 |
| JP | 2008-55852 | A | 3/2008 |
| JP | 2008-087283 | A | 4/2008 |
| JP | 2008-213333 | A | 9/2008 |
| JP | 2008-246787 | A | 10/2008 |
| JP | 2009-000915 | A | 1/2009 |
| JP | 2009-000916 | A | 1/2009 |
| JP | 2009-045851 | A | 3/2009 |
| JP | 2009-61644 | A | 3/2009 |
| JP | 2009-072927 | A | 4/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-63001 | A | 3/2011 |
| JP | 2011-245865 | A | 12/2011 |
| JP | 2012-116617 | A | 6/2012 |
| JP | 2012-183798 | A | 9/2012 |
| JP | 2013-10267 | A | 1/2013 |
| JP | 2014-193599 | A | 10/2014 |
| JP | 2015-16687 | A | 1/2015 |
| JP | 2015-96562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| WO | 2015/034027 | A1 | 3/2015 |
| WO | 2017/119044 | A1 | 7/2017 |
| WO | 2017/119045 | A1 | 7/2017 |
| WO | 2017/119046 | A1 | 7/2017 |
| WO | 2017/119047 | A1 | 7/2017 |
| WO | 2017/119049 | A1 | 7/2017 |
| WO | 2018/105215 | A1 | 6/2018 |

OTHER PUBLICATIONS

Search Report and Written Opinion in Singapore Application No. 11201805829P (dated Sep. 17, 2018).
First Office Action in Chinese Application No. 201680078027.X (dated Apr. 25, 2019).
First Office Action in Chinese Application No. 201680078100.3 (dated Apr. 25, 2019).
First Office Action in Chinese Application No. 201680078028.4 (dated Apr. 28, 2019).
Extended European Search Report in European Application No. 16883554.4 (dated Jul. 11, 2019).
Extended European Search Report in European Application No. 16883550.2 (dated Jul. 12, 2019).
Extended European Search Report in European Application No. 16883551.0 (dated Jul. 12, 2019).
Extended European Search Report in European Application No. 16883553.6 (dated Jul. 12, 2019).
Machine translation of JP 2008-213333 (Sep. 18, 2008).
Machine translation of JP 2009-061644 (Mar. 26, 2009).
Machine translation of 2015-098097 (May 28, 2015).
Machine translation of 2015-145117 (Aug. 13, 2015).
Extended European Search Report in European Application No. 16883546.0 (dated Jul. 23, 2019).
Extended European Search Report in European Application No. 16883549.4 (dated Jul. 23, 2019).
International Preliminary Report on Patentability in International Application No. PCT/JP2016/005246 (dated Jul. 2018).
International Search Report in International Application No. PCT/JP2016/005246 (dated Mar. 2017).
Ohnishi et al., U.S. Appl. No. 16/022,223, filed Jun. 28, 2018.
Ohnishi et al., U.S. Appl. No. 16/018,182, filed Jun. 26, 2018.
Yamane et al., U.S. Appl. No. 16/022,143, filed Jun. 28, 2018.
Honda et al., U.S. Appl. No. 16/022,169, filed Jun. 28, 2018.
Ohnishi et al., U.S. Appl. No. 16/022,189, filed Jun. 28, 2018.
Ohnishi et al., U.S. Appl. No. 16/013,276, filed Jun. 20, 2018.
Hirokawa et al., U.S. Appl. No. 16/015,734, filed Jun. 22, 2018.
Torisaka et al., U.S. Appl. No. 16/019,905, filed Jun. 27, 2018.

* cited by examiner

INK JET RECORDING APPARATUS

CROSS-REFERENCE TO RELATED APPLICATIONS

This application is a Continuation of International Patent Application No. PCT/JP2016/005246, filed Dec. 28, 2016, which claims the benefit of Japanese Patent Application Nos. 2016-000746, filed Jan. 5, 2016, and 2016-106189, filed May 27, 2016, all of which are hereby incorporated by reference herein in their entirety.

BACKGROUND OF THE INVENTION

Field of the Invention

The present invention relates to an ink jet recording apparatus.

Description of the Related Art

In an ink jet recording method, an image is formed by directly or indirectly applying a liquid composition (ink) containing a coloring material onto a recording medium such as paper. At this time, curling and cockling may occur due to excessive absorption of a liquid component in ink by the recording medium.

Here, in order to rapidly remove the liquid component in the ink, a method of drying a recording medium using means such as warm air or infrared rays or a method of forming an image on a transfer body, then drying a liquid component contained in the image on the transfer body by thermal energy or the like, and then transferring the image onto the recording medium such as paper is provided.

Further, as means for removing the liquid component contained in the image on the transfer body, a method of absorbing and removing the liquid component from the ink image by bringing a roller-shaped porous body into contact with the ink image without using thermal energy has been proposed (Japanese Patent Application Laid-Open No. 2009-45851 and Japanese Patent Application Laid-Open No. 2005-161610). Also, a method of absorbing and removing the liquid component from the ink image by bringing a belt-like polymeric absorber into contact with the ink image has been proposed (Japanese Patent Application Laid-Open No. 2001-179959).

However, in the methods disclosed in Japanese Patent Application Laid-Open Nos. 2009-45851, 2005-161610, and 2001-179959, at the time of absorbing and removing the liquid component from the ink image by bringing the porous body or the like into contact with the ink image on the transfer body, adhesion of a coloring material to the porous body or the like, or so called "smeared image" in which a liquid, the coloring material, or a portion of solid content or the like other than the coloring material in the ink is swept to the rear end side of the image is likely to occur. Accordingly, an object of the present invention is to provide an ink jet recording apparatus which is capable of suppressing adhesion of a coloring material and a smeared image.

SUMMARY OF THE INVENTION

According to one aspect of the present invention, there is provided an ink jet recording apparatus including an image forming unit that forms a first image including a first liquid and a coloring material on an ink receiving medium; and a liquid absorbing member that includes a porous body which is configured to be brought into contact with the first image so as to absorb at least a portion of the first liquid from the first image, in which an average pore diameter of a first surface of the porous body which is configured to be brought into contact with the first image is equal to or smaller than 0.6 μm, an arithmetic average roughness Ra defined by JIS B 0601:2001 of the first surface of the porous body is equal to or smaller than 1.9 μm, an average pore diameter of a second surface, which is a back surface of the first surface, of the porous body is larger than the average pore diameter of the first surface, and a Gurley value defined by JIS P 8117 of the porous body is equal to or shorter than 10 seconds.

According to another aspect of the present invention, there is provided an ink jet recording apparatus including an image forming unit that forms a first image on an ink receiving medium by applying ink containing a first liquid and a coloring material to the ink receiving medium; and a liquid absorbing member including a porous body which is configured to be brought into contact with the first image so as to concentrate ink constituting the first image, in which an average pore diameter of a first surface of the porous body which is configured to be brought into contact with the first image is equal to or smaller than 0.6 μm, an arithmetic average roughness Ra defined by JIS B 0601:2001 of the first surface of the porous body is equal to or smaller than 1.9 μm, an average pore diameter of a second surface, which is a back surface of the first surface, of the porous body is larger than the average pore diameter of the first surface, and a Gurley value defined by JIS P 8117 of the porous body is equal to or shorter than 10 seconds.

Further features of the present invention will become apparent from the following description of exemplary embodiments with reference to the attached drawings.

DESCRIPTION OF THE EMBODIMENTS

Figure 1:
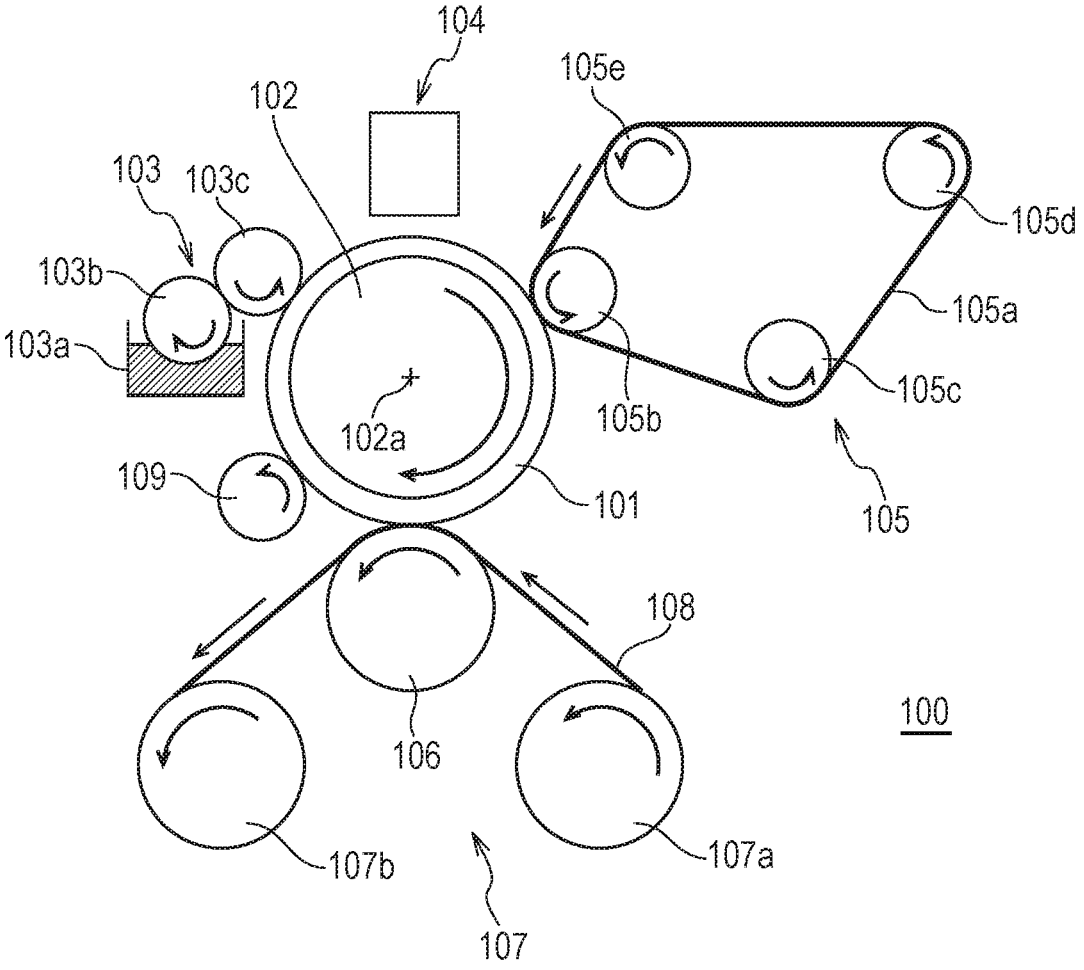
FIG. 1 is a schematic diagram illustrating one example of a configuration of a transfer type ink jet recording apparatus in one embodiment according to the present invention.

Hereinafter, the present invention will be described in detail with reference to preferred embodiments.

An ink jet recording apparatus of the present invention includes an image forming unit that forms a first image including a first liquid and a coloring material on an ink receiving medium; and a liquid absorbing member that includes a porous body which is configured to be brought into contact with the first image so as to absorb at least a portion of the first liquid from the first image. When the liquid absorbing member containing the porous body is brought into contact with the first image on the ink receiving medium which contains the first liquid and the coloring material, at least a portion of the first liquid is removed from the first image. As a result, curling and cockling caused by excessive absorption of the first liquid in the first image by the recording medium such as paper are suppressed. It is not necessary to absorb all of the first liquid.

In the ink jet recording apparatus of the present invention, an average pore diameter of a first surface of the porous body which is brought into contact with the first image is equal to or smaller than 0.6 μm. In addition, an arithmetic average roughness Ra defined by JIS B 0601:2001 of the first surface of the porous body is equal to or smaller than 1.9 μm. Further, an average pore diameter of a second surface, which is a back surface of the first surface, of the porous body is larger than the average pore diameter of the first surface. In addition, a Gurley value defined by JIS P 8117 of the porous body is equal to or shorter than 10 seconds. In the present invention, it is presumed that by satisfying these requirements, the first surface of the porous body has a small deformation and a small pore diameter and a low flow resistance, and thus it is possible to sufficiently absorb and remove the first liquid, thereby suppressing the adhesion of the coloring material and the smeared image.

In the ink jet recording apparatus of the present invention, the image forming unit is not particularly limited as long as it can form a first image including the first liquid and the coloring material on the ink receiving medium. The image forming unit preferably includes 1) a device for applying a first liquid composition containing the first liquid or a second liquid, and an ink viscosity-increasing component onto the ink receiving medium; and 2) a device for applying a second liquid composition containing the first liquid or the second liquid, and the coloring material onto the ink receiving medium, and forms the first image as a mixture of the first and second liquid compositions.

In general, the second liquid composition is ink containing the coloring material, and the device for applying the second liquid composition onto the ink receiving medium is an ink jet recording device. In addition, the first liquid composition contains a component (ink viscosity-increasing component) which chemically or physically acts with the second liquid composition to thereby viscously thicken a mixture of the first and second liquid compositions more than each of the first and second liquid compositions.

Note that, the order of a step of applying the first liquid composition to the ink receiving medium, and a step of applying the second liquid composition to the ink receiving medium is not particularly limited, but from the viewpoint of realizing the high quality of the image, the image forming step preferably includes the step of applying the first liquid composition to the ink receiving medium and the step of applying the second liquid composition to the ink receiving medium in this order. That is, the image forming step preferably includes the step of applying the first liquid composition to the ink receiving medium, and the step of applying the second liquid composition to the ink receiving medium such that at least a portion of the applied second liquid composition overlaps with a region to which the first liquid composition is applied in this order. For this reason, it is preferably that the device for applying the first liquid composition to the ink receiving medium and the device for applying the second liquid composition to the ink receiving medium are disposed so as to be able to apply the first liquid composition onto the ink receiving medium, and to apply the second liquid composition such that at least a portion of the applied second liquid composition and a region to which the first liquid composition is applied overlap.

At least one of the first and second liquid compositions includes the first liquid. Here, the first liquid includes a liquid having low volatility at normal temperature (room temperature), and particularly includes water. The second liquid is a liquid other than the first liquid, and although it does not matter whether the volatility is high or low, it is preferably a liquid having higher volatility than that of the first liquid. Hereinafter, the first liquid composition is referred to as a "reaction liquid", and the device for applying the first liquid composition onto the ink receiving medium is referred to as a "reaction liquid applying device". Further, the second liquid composition is referred to as "ink", and the device for applying the second liquid composition onto the ink receiving medium is referred to as an "ink applying device".

In addition, the first image is an ink image before liquid removal before being subjected to liquid absorption treatment by the liquid absorbing member. An ink image after liquid removal in which the content of the first liquid is reduced by performing the liquid absorption treatment is referred to as a second image. In the following description, as a pretreatment to the porous body used for the liquid absorbing member, a process of preliminarily wetting the porous body with the wetting liquid will be described.

<Reaction Liquid Applying Device>

The reaction liquid applying device may be any device as long as the reaction liquid can be applied onto the ink receiving medium, and various known devices can be appropriately used. Specifically, examples thereof include a gravure offset roller, an ink jet head, a die coating device (die coater), and a blade coating device (blade coater). The application of the reaction liquid by the reaction liquid applying device may be performed before application of the ink or after application of the ink as long as the reaction liquid on the ink receiving medium can be mixed (reacted) with the ink. The reaction liquid is preferably applied before the application of the ink. When the reaction liquid is applied before the application of the ink, it is also possible to suppress bleeding in which adjacently applied inks are mixed with each other or beading in which the previously landed ink is attracted to the ink landed later during the image recording by the ink jet method.

<Reaction Liquid>

The reaction liquid contains a component that increases the viscosity of the ink (ink viscosity-increasing component). Here, an increase in viscosity of an ink means that a coloring material, a resin, or the like which is a component constituting the ink chemically reacts by contact with an ink viscosity-increasing component, or physically adsorbs the ink viscosity-increasing component, and as a result, an increase in the viscosity of the ink is observed. The increase in viscosity of an ink includes not only the case where the increase in the ink viscosity is observed, but also a case where a portion of the component constituting the ink such as the coloring material and the resin aggregates and the viscosity is locally increased. The ink viscosity-increasing component has an effect of reducing the fluidity of a portion of the ink and/or the component constituting the ink on the ink receiving medium so as to suppress bleeding and beading during the first image formation.

In the present invention, the increasing of the viscosity of the ink is also referred to as "viscously thickening the ink". Known materials such as a polyvalent metal ion, organic acid, a cationic polymer, and a porous fine particle can be used as such an ink viscosity-increasing component. Among these, the polyvalent metal ion and the organic acid are particularly preferable. In addition, it is also preferable to include plural kinds of the ink viscosity-increasing components. Note that, the content of the ink viscosity-increasing component in the reaction liquid is preferably equal to or greater than 5% by mass with respect to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$ and $Zn^{2+}$, and trivalent metal ions such as $Fe^{3+}$, $Cr^{3+}$, $Y^{3+}$, and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid, and dioxsuccinic acid.

The reaction liquid may contain water or an organic solvent of low volatility in an appropriate amount as the first liquid. Water used in this case is preferably deionized water by ion exchange or the like. The organic solvent that can be used in the reaction liquid applied to the present invention is not particularly limited, and known organic solvents can be used.

The reaction liquid can be used by appropriately adjusting the surface tension and the viscosity by adding a surfactant or a viscosity adjusting agent. The material to be used is not particularly limited as long as it can coexist with the ink viscosity-increasing component. Specific examples of the surfactant include acetylene glycol ethylene oxide adduct ("Acetylenol E100" (product name), manufactured by Kawaken Fine Chemicals Co., Ltd.), and perfluoroalkyl ethylene oxide adduct ("Megafac F444" (product name), manufactured by DIC Corporation).

<Ink Applying Device>

An ink jet head is used as an ink applying device for applying ink. Examples of the ink jet head include a form in which ink is discharged by causing film boiling in the ink by an electro-thermal converter so as to form bubbles, a form in which ink is discharged by an electro-mechanical converter, and a form in which ink is discharged by using static electricity. In the present invention, a known ink jet head can be used. Particularly, from the viewpoint of high-speed and high-density printing, one utilizing an electro-thermal converter is suitably used. Drawing receives an image signal and applies a necessary amount of ink to each position.

An ink applying amount can be expressed by the image density (duty) or the ink thickness; however, in the present invention, an average value obtained by multiplying the mass of each of the ink dots by the number of ink dots to be applied and dividing by the printing area was set as the ink applying amount ($g/m^2$). Note that, from the viewpoint of removing the liquid component in the ink, the maximum ink applying amount in the image region indicates an ink applying amount in an area of at least equal to or larger than 5 $mm^2$ in a region used as information of the ink receiving medium.

The ink jet recording apparatus of the present invention may include a plurality of ink jet heads for applying various colors of ink onto the ink receiving medium. For example, in a case of forming respective color images using yellow ink, magenta ink, cyan ink, and black ink, the ink jet recording apparatus includes four ink jet heads that discharge each of the above four kinds of ink onto an ink receiving medium.

In addition, the ink applying device may include an ink jet head that discharges ink (clear ink) which does not contain a coloring material.

<Ink>

Each component of the ink applied to the present invention will be described.

(Coloring Material)

The coloring material contained in the ink applied to the present invention preferably includes a pigment. For example, it is preferable to use a pigment or a mixture of a dye and the pigment as a coloring material. The kinds of the pigments which can be used as a coloring material are not particularly limited. Specific examples of the pigment include an inorganic pigment such as carbon black; and an organic pigment such as an azo-based organic pigment, a phthalocyanine-based organic pigment, a quinacridone-based organic pigment, an isoindolinone-based organic pigment, an imidazolone-based organic pigment, a diketopyrrolopyrrole-based organic pigment, and a dioxazine-based organic pigment. These pigments may be used alone or if necessary, two or more kinds thereof may be used in combination.

The kinds of the dyes which can be used as a coloring material are not particularly limited. Specific examples of the dye include direct dyes, acidic dyes, basic dyes, disperse dyes, edible dyes and the like, and dyes having anionic groups can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass to 15.0% by mass, and is more preferably 1.0% by mass to 10.0% by mass with respect to the total mass of the ink.

(Dispersant)

As a dispersant for dispersing the pigment, a known dispersant used for ink jet ink can be used. In the embodiment of the present invention, it is particularly preferable to use a water-soluble dispersant having both a hydrophilic portion and a water repellent portion in the structure thereof. In particular, a pigment dispersant containing a resin obtained by copolymerizing at least a hydrophilic monomer and a water repellent monomer is preferably used. The monomers used here are not particularly limited, and known monomers are preferably used. Specific examples of the water repellent monomer include styrene and other styrene derivatives, alkyl (meth)acrylate, and benzyl (meth)acrylate. Examples of the hydrophilic monomer include acrylic acid, methacrylic acid, and maleic acid.

The acid value of the dispersant is preferably 50 mgKOH/g to 550 mgKOH/g. In addition, a weight average molecular weight of the dispersant is preferably 1,000 to 50,000. Note that, a mass ratio (pigment:dispersant) of the pigment to the dispersant is preferably in a range of 1:0.1 to 1:3.

In the present invention, it is also preferable to use a so-called self-dispersion pigment in which the pigment itself is surface-modified so that it can be dispersed without using a dispersant.

(Resin Fine Particle)

The ink applied to the present invention can contain various fine particles which do not contain coloring materials. Among these, the resin fine particle is effective in improving image quality and fixing property in some cases, and thus is preferable.

The materials of the resin fine particles that can be used in the present invention are not particularly limited, and known resins can be appropriately used. Specific examples thereof include a homopolymer such as polyolefin, polystyrene, polyurethane, polyester, polyether, polyurea, polyamide, polyvinyl alcohol, poly (meth)acrylic acid, salts thereof, alkyl poly (meth)acrylate, and polydiene, or a copolymer obtained by polymerizing a combination of a plurality of monomers for producing these homopolymers. The weight average molecular weight of the resin (Mw) is preferably in a range of 1,000 to 2,000,000. The amount of the resin fine particles in the ink is preferably 1% by mass to 50% by mass, and is more preferably 2% by mass to 40% by mass, with respect to the total mass of the ink.

Further, in the embodiment of the present invention, it is preferable to use the resin fine particle dispersion in which the resin fine particles are dispersed in a liquid. The method of dispersion is not particularly limited, and a so-called self-dispersion type resin fine particle dispersion in which the resin fine particles are dispersed using a resin obtained by homopolymerizing a monomer having a dissociable group or copolymerizing a plurality of kinds of monomers is suitable. Here, examples of the dissociable group include a carboxyl group, a sulfonic acid group, and a phosphoric acid group, and examples of the monomer having such a dissociable group include acrylic acid and methacrylic acid. In addition, a so-called emulsion dispersion type resin fine particle dispersion in which the resin fine particles are dispersed with an emulsifier can likewise be suitably used in the present invention. A known surfactant is preferable as the emulsifier, regardless of low molecular weight and high molecular weight. The surfactant is preferably a nonionic surfactant or a surfactant which has the same electron as that of the resin fine particle.

The resin fine particle dispersion used in the embodiment of the present invention preferably has a dispersed particle diameter of 10 nm to 1,000 nm, and more preferably has a dispersed particle diameter of 50 nm to 500 nm, and still more preferably has a dispersed particle diameter of 100 nm to 500 nm.

In addition, when the resin fine particle dispersion used in the embodiment of the present invention is prepared, it is also preferable to add various additives for stabilization. Examples of such additives include n-hexadecane, dodecyl methacrylate, stearyl methacrylate, chlorobenzene, dodecyl mercaptan, blue dye (bluing agent), and polymethyl methacrylate.

(Curing Component)

In the present invention, it is preferable that a component that is cured by active energy rays is contained in either the reaction liquid or the ink. By curing the component to be cured by the active energy rays before the liquid absorbing step, the adhesion of the coloring material to the liquid absorbing member may be suppressed in some cases.

As a component to be cured by being irradiated with the active energy rays used in the present invention, a component that is cured by being irradiated with the active energy rays and increases its insolubility than that of before irradiation is used. As an example, a general ultraviolet curable resin can be used. Many of the ultraviolet curable resins are insoluble in water, but as a material that can be applied to the water-based ink suitably used in the present invention, a material having at least an ethylenically unsaturated bond curable with ultraviolet rays in the structure thereof and having a hydrophilic bonding group is preferable. Examples of the bonding group for having hydrophilicity include a hydroxyl group, a carboxyl group, a phosphoric acid group, a sulfonic acid group and salts thereof, an ether bond, and an amide bond. In addition, the component, which is to be cured, and used in the present invention is preferably hydrophilic.

Further, examples of the active energy rays include ultraviolet rays, infrared rays, and electron beams.

In the present invention, it is preferable that a polymerization initiator is contained in either the reaction liquid or the ink. The polymerization initiator used in the present invention may be any compound as long as it generates radicals by active energy rays.

Further, in order to improve the reaction rate, it is one of extremely preferable embodiments to use a sensitizer having a role of widening the light absorption wavelength in combination.

(Surfactant)

The ink that can be used in the present invention may contain a surfactant. Specific examples of the surfactant include acetylene glycol ethylene oxide adduct (Acetylenol E100, manufactured by Kawaken Fine Chemicals Co., Ltd.) and the like. The amount of the surfactant in the ink is preferably 0.01% by mass to 5.0% by mass with respect to the total mass of the ink.

(Water and Water-Soluble Organic Solvent)

The ink used in the present invention may contain water and/or a water-soluble organic solvent as a solvent. Water is preferably deionized water by ion exchange or the like. In addition, the content of the water in the ink is preferably 30% by mass to 97% by mass with respect to the total mass of the ink, and is more preferably 50% by mass to 95% by mass with respect to the total mass of the ink.

Further, the kinds of the water-soluble organic solvent to be used are not particularly limited, and any of known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Of course, it is also possible to mix and use two or more kinds selected from them.

In addition, the content of the water-soluble organic solvent in the ink is preferably 3% by mass to 70% by mass with respect to the total mass of the ink.

(Other Additives)

In addition to the above components, as necessary, the ink that can be used in the present invention may contain other additives such as a pH adjuster, a rust preventive, an antiseptic, a mildewproofing agent, an antioxidant, a reduction preventing agent, a water soluble resin and its neutralizing agent, a viscosity adjusting agent, and the like.

<Liquid Absorbing Member>

In the present invention, when at least a portion of the first liquid is absorbed from the first image by being brought into contact with the liquid absorbing member having the porous body, the content of the liquid component in the first image is decreased. The contact surface of the liquid absorbing member with the first image is set as the first surface, and the porous body is disposed on the first surface. The liquid absorbing member containing such a porous body preferably has a shape which is capable of absorbing the liquid by moving in conjunction with the movement of the ink receiving medium to come in contact with the first image, then circulating at a predetermined cycle, and then coming again in contact with another first image. For example, an endless belt shape or a drum shape can be exemplified.

(Porous Body)

The present inventors have found that the adhesion of the coloring material and the smeared image can be suppressed by the porous body satisfying the following requirements (i) to (iv).

(i) The average pore diameter of the first surface of the porous body is equal to or smaller than 0.6 μm.

(ii) An arithmetic average roughness Ra defined by JIS B 0601:2001 of the first surface of the porous body is equal to or smaller than 1.9 μm.

(iii) The average pore diameter of the second surface of the porous body is larger than the average pore diameter of the first surface.

(iv) A Gurley value defined by JIS P 8117 of the porous body is equal to or shorter than 10 seconds.

Although the details of a mechanism by which the adhesion of the coloring material and the smeared image can be suppressed have not been determined, by the porous body satisfying the requirements of (i) to (iv), the following mechanism is presumed, for example. It is presumed that when the coloring material, the other solid contents, and the like in the ink are aggregated by the reaction liquid, the apparent size of the solid content becomes larger, and thereby the adhesion of the coloring material is suppressed. Here, in order to suppress the adhesion of the coloring material to the first surface of the porous body, it is required to bring the porous body into contact with the first image to the extent that the agglomerate does not collapse. In this case, it is considered that the smaller the deformation of the first surface of the porous body is, the more preferable, and the smaller the pore diameter of the first surface of the porous body is, the more preferable. In the present invention, it is presumed that by satisfying the above-described requirements, the first surface of the porous body has a low flow resistance in a state of having a small deformation and a small pore diameter, and thus it is possible to sufficiently absorb and remove the first liquid, thereby suppressing the adhesion of the coloring material and the smeared image.

The average pore diameter of the first surface (hereinafter, also referred to as "surface of the porous body") of the porous body which is brought into contact with the first image is equal to or smaller than 0.6 μm, is preferably equal to or smaller than 0.5 μm, and is more preferably equal to or smaller than 0.2 μm. When the average pore diameter is equal to or smaller than 0.6 μm, the filtering property is increased and the adhesion of the coloring material to the porous body is suppressed. The lower limit of the average pore diameter is not particularly limited, and it may be equal to or larger than 0.02 μm, for example. In the present invention, the "average pore diameter" is an average value which is observed using an electron microscope, and is obtained by calculating the diameter in a case where an area of a hole portion is an area of a circle, and measuring 20 or more calculated diameters.

The arithmetic average roughness Ra defined by JIS B 0601:2001 of the surface of the porous body is equal to or smaller than 1.9 μm, is preferably equal to or smaller than 1.5 μm, is more preferably equal to or smaller than 1.0 μm, and is still more preferably equal to or smaller than 0.4 μm. When the Ra is equal to or smaller than 1.9 μm, pressure unevenness is further decreased at the time when the porous body is brought into contact with the first image, and thus the adhesion amount of coloring material can be decreased. The lower limit of the Ra is not particularly limited, and it may be equal to or larger than 0.3 μm, for example.

Note that, the porous body or the surface shape (arithmetic average roughness Ra) of each layer constituting the porous body can be measured by synthesizing data obtained by scanning the reflection in an observation measurement range in a Z axis direction using a laser microscope (for example, a semiconductor laser having a wavelength of about 405 nm) using a confocal optical system by a pinhole or the like. Specifically, the arithmetic average roughness Ra is measured by the following method. Using a VK 9710 laser microscope (product name, manufactured by Keyence Corporation), data with a depth of 200 μm from the surface is obtained in RPD form using an objective lens 50 times (CF IC EPI PLAN Apo 50×, manufactured by Nikon Corporation). The obtained data is processed with a noise filter (median), and the surface roughness is calculated with a cutoff λc of 0.08 μm and a reference line length of 200 μm.

The average pore diameter of the second surface that is the back surface of the first surface of the porous body, that is, a surface opposite to the first surface (hereinafter, also referred to as a "back surface of the porous body" or the "second surface facing the first surface") is larger than the average pore diameter of the surface of the porous body. When the average pore diameter of the surface of the porous body is equal to or smaller than 0.6 μm, filterability is enhanced and the adhesion of the coloring material to the porous body is suppressed, but smeared image tends to occur due to an increase in the flow resistance. However, when the average pore diameter of the back surface (the second surface of the porous body) of the porous body is larger than the average pore diameter of the surface (the first surface of the porous body), the flow resistance can be lowered, thereby suppressing the smeared image. Note that, the average pore diameter of the back surface of the porous body is preferably 4 μm to 40 μm, and is more preferably 6 μm to 36 μm.

The Gurley value of the porous body is measured by a Gurley testing machine defined by JIS P 8117 of the porous body. The Gurley value of the porous body in the present invention is equal to or shorter than 10 seconds, is preferably equal to or shorter than 7 seconds, is more preferably equal to or shorter than 5 seconds, and is still more preferably equal to or shorter than 3 seconds. It is presumed that when the Gurley value is equal to or shorter than 10 seconds, the flow resistance is lowered, and thus the first liquid can be sufficiently absorbed and removed within the contact time, and the smeared image can be suppressed. The lower limit of the Gurley value is not particularly limited, and it may be equal to or longer than one second, for example. The lower the Gurley value, the higher the air permeability. The Gurley value can be set to a low value by, for example, thinning the thickness itself before forming a later-described first layer as a porous body at the time of forming the first layer.

(Embodiment in which First Layer and Second Layer are Included)

In the present invention, as one embodiment of the porous body, the porous body includes a first layer that is configured to be brought into contact with the first image and a second layer. At this time, in a case where the first layer is thin and the first layer is formed of a porous fluororesin such as PTFE (polytetrafluoroethylene), it was found that the adhesion of the coloring material and the smeared image are likely to occur due to an average interval of the local peak of the second layer laminated on the first layer. Specifically, when the average interval of the local peak is large, the first layer is likely to be deformed, and thereby the adhesion of the coloring material is likely to occur. On the other hand, when the average interval of the local peak is small, the air permeability is lowered, and thereby the smeared image is likely to occur.

Therefore, as a result of repeated studies on the water pressure resistance and the thickness of the first layer and the average interval of the local peak of the second layer, the inventors of the present invention have found that when the following requirements (a) to (c) are satisfied, both an effect of suppressing deformation and the air permeability can be achieved. With this, it is possible to further suppress the adhesion of the coloring material and the smeared image.

(a) The average pore diameter of a first surface (hereinafter, also referred to as a "surface of the first layer") of the first layer to be brought into contact with the first image is equal to or smaller than 0.6 μm.

(b) The thickness of the first layer is equal to or smaller than 35 μm.

(c) The average interval of the local peak defined by JIS B 0601:1994 in a first surface (hereinafter, also referred to as a "surface of the second layer") of the second layer on the side of the first layer is 3 μm to 40 μm.

Figure 6:
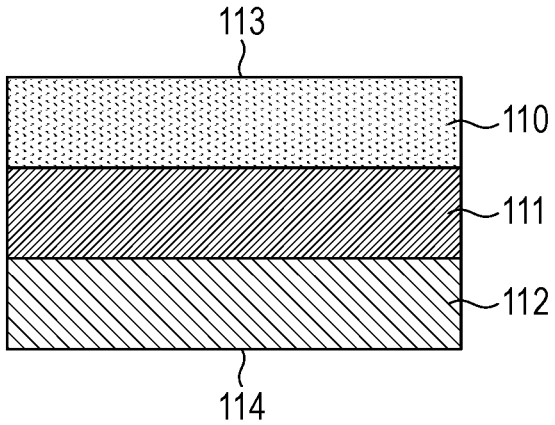
FIG. 6 is a sectional view illustrating one example of a porous body in one embodiment of the present invention.

As described below, the porous body preferably includes a third layer as a support layer, and as illustrated in FIG. 6, it is more preferable that a first layer 110, a second layer 111, and a third layer 112 are included in this order. Further, another layer may be included on the third layer. Further, another layer may be included between each layer as long as the effect of the present invention can be obtained. In the present invention, it is preferable that the first layer and the second layer are in direct contact with each other. Hereinafter, a face of the first layer facing the surface of the first layer, that is, a face opposite to the surface of the first layer is also referred to as a "back surface of the first layer".

Figure 7:
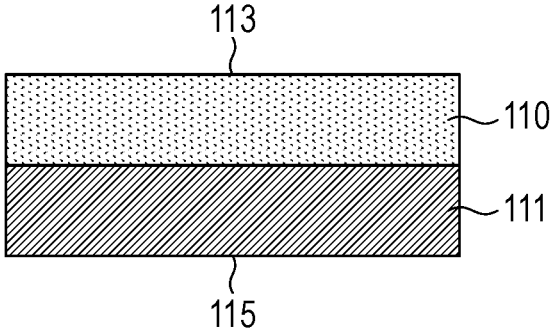
FIG. 7 is a sectional view illustrating another example of a porous body in one embodiment of the present invention.

Further, in the present invention, the surface to be brought into contact with the first image (the first surface (surface) of the porous body) is a surface 113 of the first layer, and the second surface (the second surface (back surface) of the porous body) facing the surface of the first layer indicates a back surface 114 of the third layer in a case of including a third layer 112. Hereinafter, a face of the second layer facing the surface of the second layer, that is, a face opposite to the surface of the second layer is also referred to as a "back surface of the second layer". In the present invention, as illustrated in FIG. 7, in a case of the configuration of the first layer 110 and the second layer 111, the face to be brought into contact with the first image is the surface 113 of the first layer, and the second surface facing the surface of the first layer indicates a back surface 115 of the second layer. In the present invention, the porous body may be a material having a large number of pores, for example, a material having many pores formed by the intersection of the fibers is also included in the porous body of the present invention.

(First Layer)

The first layer preferably contains a fluororesin, and is more preferably formed of a fluororesin. The fluororesin has low surface free energy and high cleaning ability. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene-propylenehexafluoride copolymer (FEP), an ethylene-tetrafluoroethylene copolymer (ETFE), and an ethylene chlorotrifluoroethylene copolymer (ECTFE). As the fluororesin, polyolefins such as polyethylene (PE) and polypropylene (PP), polyamides such as polyurethane and nylon, polyesters such as polyethylene terephthalate (PET), polysulfone (PSF), polyamide imide (PAI), polyacrylonitrile (PAN), metal such as aluminum, a metal oxide such as alumina, and a composite material thereof can be also used. These may be used alone, or two or more kinds thereof may be used in combination. In a case of using a metal oxide such as alumina, the surface roughness can be lowered by polishing with a free abrasive grain.

The average pore diameter of the surface of the first layer is equal to or smaller than 0.6 μm, is preferably equal to or smaller than 0.5 μm, and is more preferably equal to or smaller than 0.2 μm. When the average pore diameter is equal to or smaller than 0.6 μm, the filtering property is increased and the adhesion of the coloring material to the porous body is suppressed. The lower limit of the average pore diameter is not particularly limited, and it may be equal to or larger than 0.02 μm, for example.

The thickness of the first layer is preferably equal to or smaller than 35 μm, is more preferably equal to or smaller than 25 μm, and is still more preferably equal to or smaller than 20 μm. Even when the average pore diameter of the surface of the first layer is equal to or smaller than 0.6 μm, by setting the thickness to be equal to or smaller than 35 μm, the increase in the flow resistance can be suppressed, and the smeared image can be suppressed. The thickness is preferably equal to or larger than 1 μm. The thickness is a value obtained by measuring the thickness of arbitrary 10 points with a straight type micrometer (product name: OMV-25, manufactured by Mitutoyo Corporation) and calculating the average value thereof.

(Second Layer)

The average interval of the local peak defined by JIS B 0031:1994 on the surface of the second layer is preferably 3 μm to 40 μm. The average interval of the local peak is more preferably 5 μm to 35 μm, is still more preferably 10 μm to 30 μm, and particularly preferably 15 μm to 25 μm. It is considered that when the average interval of the local peak is equal to or larger than 3 μm, the first layer is difficult to be deformed, and thus the adhesion of the coloring material is difficult to occur. It is presumed that when the average interval of the local peak is equal to smaller than 40 μm, the air permeability is sufficiently high, and thus the smeared image can be easily suppressed.

Note that, the average interval of the local peak is measured by the following method. Using a VK 9710 laser microscope (product name), manufactured by Keyence Corporation, data with a depth of 200 μm from the surface is obtained in RPD form using an objective lens 50 times (CF IC EPI PLAN Apo 50× (product name), manufactured by Nikon Corporation). The obtained data is processed with a noise filter (median), and the average interval of the local peak from a sectional profile is calculated with a cutoff λc of 0.08 μm and a reference line length of 200 μm. Note that, it is possible to use mean width of the profile elements RSm defined by ISO 4287:1997 instead of the average interval of the local peak defined by JIS B 0031:1994.

The arithmetic average roughness Ra defined by JIS B 0601:2001 of the surface of the second layer is preferably equal to or smaller than 10 μm, is more preferably equal to or smaller than 6 μm, and is still more preferably equal to or smaller than 4 μm. It is considered that when the Ra is equal to or smaller than 10 μm, the first layer is difficult to be deformed, and thus the adhesion of the coloring material is difficult to occur.

The material of the second layer is not particularly limited, and examples thereof include polyolefins such as polyethylene (PE) and polypropylene (PP), polyamides such as polyurethane and nylon, polyesters such as polyethylene terephthalate (PET), polysulfone (PSF), a fluororesin, and a composite material thereof. These may be used alone, or two or more kinds thereof may be used in combination.

The second layer preferably contains (1) a first fiber and a second fiber, or (2) a fiber containing a first material and a second material. Each case will be explained below. In the present invention, the "softening point" refers to a melting point in a case of the fiber having the melting point, and a glass transition point in a case of the fiber having no melting point but having the glass transition point. Further, the average fiber diameter of the fiber is a value obtained by observing the fiber surface with a scanning electron microscope, measuring the thickness of optional ten or more fibers, and calculating the average value thereof.

(1) Case where Second Layer Contains First Fiber and Second Fiber

The average fiber diameter of the first fiber is preferably 0.1 μm to 15.0 μm, is more preferably 0.5 μm to 10.0 μm, and is still more preferably 1.0 μm to 5.0 μm. It is presumed that when the average fiber diameter of the first fiber is equal to or greater than 0.1 μm, the air permeability is sufficiently high, and thus the smeared image can be easily suppressed. It is considered that when the average fiber diameter of the first fiber is equal to or smaller than 15.0 μm, the Ra of the surface is lowered and the first layer is difficult to be deformed, and thus the adhesion of the coloring material is difficult to occur.

The average fiber diameter of the second fiber is preferably 0.1 μm to 15.0 μm, is more preferably 0.1 μm to 10.0 μm, and is still more preferably 0.1 μm to 5.0 μm. It is presumed that when the average fiber diameter of the second fiber is equal to or greater than 0.1 μm, the air permeability is sufficiently high, and thus the smeared image can be easily suppressed. It is considered that when the average fiber diameter of the second fiber is equal to or smaller than 15.0 μm, the Ra of the surface is lowered and the first layer is difficult to be deformed, and thus the adhesion of the coloring material is difficult to occur.

In addition, the first fiber and the second fiber preferably have different average fiber diameter and/or softening point from each other. Specifically, it is preferable that the first fiber and the second fiber satisfy at least one of the following condition (1) and the following condition (2), and it is more preferable that the first fiber and the second fiber satisfy both of the following conditions (1) and (2).

Condition (1): the average fiber diameter of the first fiber is 1.2 times to 50.0 times with respect to the average fiber diameter of the second fiber.

Condition (2): An absolute value of a difference between the softening point of the first fiber and the softening point of the second fiber is equal to or higher than 10° C.

In the above condition (1), the average fiber diameter of the first fiber is 1.2 times to 50.0 times with respect to the average fiber diameter of the second fiber, is preferably 5.0 times to 40.0 times, and is more preferably 10.0 times to 30.0 times. It is presumed that when the average fiber diameter of the first fiber is 1.2 times to 50.0 times with respect to the average fiber diameter of the second fiber, an area in which the fibers are partially welded with each other is defined, and thereby both of the suppression of the increase in the flow resistance and the improvement of the adhesion strength can be achieved.

In the condition (2), specifically, the following expression is satisfied. |(softening point of first fiber)−(softening point of second fiber)|≥10° C. In the above condition (2), the absolute value of the difference between the softening point of the first fiber and the softening point of the second fiber is equal to or higher than 10° C., is preferably equal to or higher than 20° C., and is more preferably equal to or higher than 40° C. It is presumed that when the absolute value of the difference between the softening point of the first fiber and the softening point of the second fiber is equal to or higher than 10° C., an area in which the fibers are partially melted with each other is limited, and thereby both of the suppression of the increase in the flow resistance and the improvement of the adhesion strength can be achieved. Note that, the upper limit of the absolute value of the difference between the softening point of the first fiber and the softening point of the second fiber is not particularly limited, and can be set to be equal to or lower than 200° C., for example.

In addition, the mass ratio (first fiber:second fiber) of the first fiber to the second fiber contained in the second layer is preferably 20:80 to 80:20, is more preferably 30:70 to 70:30, and is still more preferably 40:60 to 60:40. It is presumed that when the mass ratio is within the range of 20:80 to 80:20, both of the strength improvement and the improvement of the adhesion strength of the second layer can be achieved.

As the material of the first fiber, for example, polyethylene, copolymerized polyethylene terephthalate or the like can be used. These may be used alone, or two or more kinds thereof may be used in combination. As the material of the second fiber, for example, polypropylene, polyethylene terephthalate or the like can be used. These may be used alone, or two or more kinds thereof may be used in combination.

(2) Case where Second Layer Contains Fiber Containing First Material and Second Material In the case where the second layer contains the fiber containing the first material and the second material, the first material and the second material may be mixed in the fiber, or a core-sheath structure constituted by the core structure and the sheath structure may be formed.

The average fiber diameter of the fiber is preferably 0.1 μm to 15.0 μm, is more preferably 0.5 μm to 10.0 μm, and is still more preferably 1.0 μm to 5.0 μm. It is presumed that when the average fiber diameter of the fiber is equal to or greater than 0.1 μm, the air permeability is sufficiently high, and thus the smeared image can be easily suppressed. It is considered that when the average fiber diameter of the fiber is equal to or smaller than 15.0 μm, the Ra of the surface is lowered and the first layer is difficult to be deformed, and thus the adhesion of the coloring material is difficult to occur.

In addition, the absolute value of the difference between the softening point of the first material and the softening point of the second material is preferably equal to or higher than 10° C., is more preferably equal to or higher than 20° C., and is still more preferably equal to or higher than 40° C. It is presumed that when the absolute value of the difference between the softening point of the first material and the softening point of the second material is equal to or higher than 10° C., an area in which the materials are partially melted with each other is limited, and thereby both of the suppression of the increase in the flow resistance and the improvement of the adhesion strength can be achieved. Note that, the upper limit of the absolute value of the difference between the softening point of the first material and the softening point of the second material is not particularly limited, and can be set to be equal to or lower than 200° C., for example.

In addition, the mass ratio (first material:second material) of the first material to the second material contained in the second layer is preferably 20:80 to 80:20, is more preferably 30:70 to 70:30, and is still more preferably 40:60 to 60:40. It is presumed that when the mass ratio is within the range of 20:80 to 80:20, both of the strength improvement and the improvement of the adhesion strength of the second layer can be achieved.

The inventors of the present invention have considered that when these conditions are satisfied, the bonding point between the first layer and the second layer becomes smaller and the interval between the bonding points also becomes narrower, and thereby both of the air permeability and the adhesion strength between the layers can be improved.

As the first material, for example, polyethylene, copolymerized polyethylene terephthalate or the like can be used. As the second material, for example, polypropylene, polyethylene terephthalate or the like can be used.

(Embodiment in which Average Pore Diameter Changes in at Least Partial Region of Porous Body in Thickness Direction)

In the present invention, as another embodiment of the porous body, the average pore diameter changes in at least a partial region of the porous body in the thickness direction (it can be said that the average particle diameter is inclined in the thickness direction in some cases). That is, in at least a partial region of the porous body, the average pore diameter in a plane perpendicular to the thickness direction is increased from the surface to the back surface of the porous body.

Although the mechanism in which the effect of the present invention can be obtained by such a constitution has not been found out, the inventors of the present invention consider that the rigidity is enhanced while maintaining the average pore diameter, the smoothness and the air permeability of the surface of the porous body, and thus the deformation is suppressed. When the average pore diameter of the surface of the porous body is equal to or smaller than 0.6 μm, filterability is enhanced and the adhesion of the coloring material to the porous body is suppressed, but the smeared image occurs due to an increase in the flow resistance in some cases. As described above, the occurrence of the smeared image can be suppressed by making the average pore diameter of the back surface of the porous body larger than the average pore diameter of the surface, but when the average pore diameter changes in the thickness direction, the smeared image can be further suppressed.

In this embodiment, the material of the porous body can be the same as the material of the first layer. Further, it is preferable that a material concentration changes in at least a partial region of the porous layer in the thickness direction. That is, in at least a partial region of the porous layer containing a plurality of materials, it is preferable that the concentration of each material changes from the surface to the back surface of the porous body. For example, in a case where a porous layer is formed of two kinds of fibers having different materials, it is preferable that there is a region in which the respective fibers are entangled, and thus the volume concentration of the material changes in the thickness direction. Due to the entanglement of the fibers, the adhesion strength is improved, and it is possible to stably suppress the adhesion of the coloring material even when the porous body is repeatedly brought into contact with an image.

In the present invention, it is preferable that the plastic deformation starting load of the porous body per unit width in a tensile test defined by JIS L 1913:2010 is equal to or greater than 200 N/m in both of the above two embodiments. The plastic deformation starting load is more preferably equal to or larger than 300 N/m, and still more preferably equal to or larger than 400 N/m. When the plastic deformation starting load is equal to or larger than 200 N/m, sufficient tension can be applied at the time of conveyance, and slipping or the like at the roller can be prevented. Further, the plastic deformation starting load is preferably equal to or smaller than 4,000 N/m, is more preferably equal to or smaller than 3,000 N/m, and is still more preferably equal to or smaller than 2,000 N/m. When the plastic deformation starting load is equal to or smaller than 4,000 N/m, flexural rigidity becomes equal to or less than a certain value, and sufficient follow-up to the roller becomes possible.

The plastic deformation starting load is measured using a tensile tester AKG-kNX (manufactured by Shimadzu Corporation). At that time, the size of the sample to be measured is set to be 25 mm±0.5 mm×150 mm, the grip interval is set to be 50 mm±0.5 mm, and the tensile rate is set to be 20±0.02 mm/min. The value obtained by dividing the load at the time when the plastic deformation is started by the width of the specimen is the plastic deformation starting load per unit width.

(Third Layer)

In both of the above two embodiments, it is preferable that the porous body further includes a third layer as a support layer. When the porous body further includes the third layer as the support layer, sufficient strength can be obtained at the time of conveyance and slipping or the like at the roller can be prevented. The third layer can be laminated on the side opposite to the side to be in contact with the first image. The third layer preferably has the air permeability. Specific examples thereof include nonwoven fabric, woven fabric, mesh (mesh net) and the like. Among them, the nonwoven fabric is preferable from the viewpoint of strength, flexibility, and workability.

The material of the third layer is not particularly limited, and examples thereof include polyolefins such as polyethylene (PE) and polypropylene (PP), polyamides such as polyurethane and nylon, polyesters such as polyethylene terephthalate (PET), polysulfone (PSF), polyamide imide (PAI), polyacrylonitrile (PAN), a fluororesin, metal such as aluminum, a metal oxide such as alumina, and a composite material thereof. These may be used alone, or two or more kinds thereof may be used in combination. In addition, when the third layer contains fibers having a core-sheath structure, the area in which the fibers are partially melted is limited, which is preferable from the viewpoint that both of the suppression of the increase in the flow resistance and the improvement of the adhesion strength can be achieved.

Also, the surface of the third layer which is in contact with the porous layer (for example, the first layer and the second layer) of the porous body is preferably smooth. In addition, the average pore diameter of the surface of the third layer is preferably equivalent to or larger than the average pore diameter of the back surface of the porous layer which is adhered to the third layer.

From the viewpoint of laminating the porous layer and the third layer by heating, it is preferable that the absolute value of the difference in softening point between the materials having the lowest softening point among the materials constituting the back surface of the porous layer, and the materials having the lowest softening point among the materials constituting the third layer is equal to or higher than 10° C. Also, in a case where the third layer is formed of fibers, it is preferable that the fiber has a core-sheath structure in which the softening point of the fiber sheath is lower than that of the fiber core.

(Method of Preparing Porous Body)

The method of preparing the porous body is not particularly limited, and in a case where the porous body includes the first layer and the second layer, a method including a step of preparing the first layer, a step of preparing the second layer, and a step of laminating each layer (the first layer and the second layer) is preferable.

A method of preparing a porous body containing the PTFE as the first layer will be described below with reference to examples. A lubricant is added to PTFE fine powder and is uniformly mixed. Examples of the PTFE fine powder include Polyfluon F-104 (product name, manufactured by Daikin Industries, Ltd.), Fluon CD-123 (product name, manufactured by Asahi Glass Co., Ltd.), and the like.

Examples of the lubricant include mineral spirits and naphtha. The lubricated PTFE fine powder is compressed in a cylinder to form a pellet, the pellet is extruded from a ram extruder in a non-fired state to form a sheet, and the formed sheet is rolled to be an appropriate thickness, for example, 0.05 to 0.7 mm by a pair of rolls. The lubricant contained in the rolled sheet is removed by heating so as to obtain a PTFE sheet. Next, the PTFE sheet is stretched in the longitudinal direction (rolling direction) of the PTFE sheet while heating, and then stretched in the width direction of the PTFE sheet while heating. It is possible to form various pore diameters, porosities, and thicknesses of the porous body by heating and stretching treatment of PTFE paste.

When stretching is performed at a relatively high speed in a direction of one or more axes at a heating temperature lower than the melting point of PTFE, the porous body of PTFE has a fibrous structure including a knotted portion, in which very small fibers are connected to each other, larger than 1 μm. In addition, the porosity thereof is as high as 40% to 97%, resulting in high strength. In addition, a method of stretching a formed body after making the formed body in a semi-fired state, and a method of stretching a formed body after heating and firing the formed body to a temperature of equal to or higher than the melting point (327° C.) of PTFE, or while heating and firing the formed body to a temperature of equal to or higher than the melting point can also be exemplified.

Further, as the first layer, a material obtained by forming a film of fluororesin fibers obtained by an electrospinning (ES) method or the like with thermal pressure or the like may be used. A method for preparing a porous layer using the electrospinning (ES) method will be described in detail below with reference to examples. In the spinning method by the electrospinning method, an electric field acts on the resin solution supplied from a resin solution supply unit such as a nozzle to a spinning space, and thereby the resin solution is stretched, fiberized, and collected on the earthed collector.

The resin solution is a solution in which an electrospinnable resin is dissolved in a solvent. The resin is not particularly limited, and examples thereof include polyacrylonitrile, polycarbonate, polyethylene, polypropylene, polyethylene oxide, polyethylene glycol, polyethylene terephthalate, polyethylene naphthalate, poly-m-phenylene terephthalate, poly-p-phenylene isophthalate, polymethacrylic acid, polymethyl methacrylate, polyvinyl chloride, polyvinylidene chloride-acrylate copolymer, polytetrafluoroethylene, polyvinylidene fluoride, a polyvinylidene fluoride-hexafluoropropylene copolymer, polyvinyl alcohol, polyvinyl pyrrolidone, polyarylate, polyacetal, polystyrene, polyphenylene sulfide, polyamide, polyimide, polyamide imide, aramid, polyimide benzazole, polybenzimidazole, polyglycolic acid, polylactic acid, polyurethane, cellulose compounds, polypeptide, polynucleoside, proteins, and enzymes. These may be used alone, or two or more kinds thereof may be used in combination.

The weight average molecular weight of the resin is preferably 10,000 to 1,000,000, and is more preferably 100,000 to 500,000. When the weight average molecular weight is equal to or larger than 10,000, the resin is less likely to be in a bead shape. In addition, when the weight average molecular weight is equal to or smaller than 1,000,000, it is likely that the resin solution is stretched, and is in a fiber shape.

The solvent contained in the resin solution is not particularly limited as long as it can dissolve the resin, and examples thereof include water, acetone, methyl isobutyl ketone, diisobutyl ketone, acetophenone, ethyl acetate, butyl acetate, methanol, ethanol, propanol, isopropanol, hexafluoroisopropanol, tetrahydrofuran, dimethyl sulfoxide, acetonitrile, formic acid, toluene, benzene, cyclohexane, cyclohexanone, carbon tetrachloride, methylene chloride, chloroform, trichloroethane, ethylene carbonate, and diethylene carbonate. These solvents can be used alone or in combination.

The concentration of the resin in the resin solution is preferably 1% to 50% by mass. When the concentration is equal to or more than 1% by mass, evaporation of the solvent is accelerated. In addition, when the concentration is equal to less than 50% by mass, the solubility of the resin is improved and it is likely that the fiber is stretched, and is in a fiber shape.

In spinning by an electrospinning method, for example, by changing a voltage, temperature, humidity, a nozzle diameter, and a distance between a nozzle and a collector, the fiber diameter can be changed. Further, by changing the fiber diameter, it is possible to change the average pore diameter of the porous layer in the thickness direction. In addition, for example, by preparing a plurality of nozzles using two or more kinds of resin solutions and changing the ratio of the supply amount of each resin solution, it is possible to change the volume ratio of the fibers in the porous layer, that is, change the material concentration. With this, it is possible to form a porous body having various average pore diameters and material concentrations.

In addition, a porous layer obtained by an electrospray method, a force spinning method, or the like in addition to the electrospinning method may be used. Further, porous layer which has different average pore diameters in the thickness direction, and is obtained by a phase separation method or the like may be used. Alternatively, a composite of a nonwoven fabric or the like and a phase separation film may be used.

In a case where the nonwoven fabric is used as the second layer, as a manufacturing method thereof, for example, a method of forming a fleece by a dry method, a wet method, a spunbond method, an ES method, or the like, and then joining fibers by a chemical bond method, a thermal bond method, a needle punching method, a hydroentanglement method, or the like can be exemplified.

As a method of laminating the first layer and the second layer, the first layer and the second layer may only be overlapped, or may be adhered to each other by using a method such as lamination by adhesive agent and lamination by heating. From the viewpoint of the air permeability, the lamination by heating is preferable. For example, by heating, a portion of the first layer or the second layer may be melted and the first layer and the second layer may be bonded and laminated. Alternatively, a fusing material such as a hot melt powder may be interposed between the first layer and the second layer such that the first layer and the second layer are adhered to each other by heating and thus are laminated.

In a case of further laminating the third layer, it may be laminated together with the first layer and the second layer, or may be laminated in order, and the order of laminating can be appropriately selected.

Specific embodiments of an ink jet recording apparatus of the present invention will be described.

Examples of the ink jet recording apparatus of the present invention include an ink jet recording apparatus which forms a first image on a transfer body as an ink receiving medium, and transfers a second image which is an image after a first liquid has been absorbed by a liquid absorbing member to a recording medium, and an ink jet recording apparatus which forms a first image on a recording medium as an ink receiving medium. In the present invention, the former ink jet recording apparatus will hereinafter be referred to as a transfer type ink jet recording apparatus for the sake of convenience, and the latter ink jet recording apparatus will hereinafter be referred to as a direct drawing type ink jet recording apparatus for the sake of convenience.

Each ink jet recording apparatus will be described below.

<Transfer Type Ink Jet Recording Apparatus>

FIG. 1 is a schematic diagram illustrating one example of a schematic configuration of the transfer type ink jet recording apparatus of the present embodiment. The transfer type ink jet recording apparatus 100 includes a transfer body 101 for temporarily holding a first image and a second image obtained by absorbing at least a portion of a first liquid from the first image. The transfer type ink jet recording apparatus 100 also includes a transfer unit including a pressing member 106 for transferring the second image onto a recording medium 108 on which an image is to be formed.

The transfer type ink jet recording apparatus 100 of the present invention includes the transfer body 101 supported by a support member 102, a reaction liquid applying device 103 for applying a reaction liquid onto the transfer body 101, an ink applying device 104 for applying ink onto the transfer body 101 on which the reaction liquid is applied so as to form an ink image (the first image) on the transfer body, a liquid absorbing device 105 for absorbing a liquid component from the first image on the transfer body, and the pressing member 106 for transferring the second image on the transfer body from which the liquid component has been removed by pressing the recording medium onto the recording medium 108 such as paper. In addition, the transfer type ink jet recording apparatus 100 may include a cleaning member for transfer body 109 for cleaning the surface of the transfer body 101 after the second image is transferred onto the recording medium 108.

The support member 102 rotates about a rotation axis 102*a* in the direction of an arrow A in FIG. 1. With the rotation of the support member 102, the transfer body 101 is moved. The application of the reaction liquid by the reaction liquid applying device 103 and the application of the ink by the ink applying device 104 are sequentially performed on the transfer body 101 to be moved, and thereby the first image is formed on the transfer body 101. The first image formed on the transfer body 101 is moved to a position where the first image comes into contact with the liquid absorbing member 105*a* of the liquid absorbing device 105 by the movement of the transfer body 101. The liquid absorbing member 105*a* of the liquid absorbing device 105 moves in synchronization with the rotation of the transfer body 101. The first image formed on the transfer body 101 passes through a state of being in contact with the moving liquid absorbing member 105*a*. During this time, the liquid absorbing member 105*a* removes the liquid component from the first image.

Note that, the liquid component contained in the first image is removed by passing through the state of being in contact with the liquid absorbing member 105*a*. In this contact state, it is preferable that the liquid absorbing member 105*a* is pressed against the first image with a predetermined pressing force in order to effectively function the liquid absorbing member 105*a*. The removal of the liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

Then, the second image after the liquid component has been removed is moved to a transfer unit which is in contact with the recording medium 108 conveyed by a conveyance device for recording medium 107 by the movement of the transfer body 101. While the second image from which the liquid component is removed and the recording medium 108 are in contact with each other, the pressing member 106 presses the recording medium 108, and thereby an ink image is transferred onto the recording medium 108. The ink image transferred onto the recording medium 108 is a reverse image of the second image. In the following description, the post-transfer ink image may be referred to as a third image separately from the first image (the ink image before liquid removal) and the second image (the ink image after liquid removal).

Note that, since the first image is formed by applying ink after the reaction liquid is applied onto the transfer body, the reaction liquid remains in a non-image region (a non-ink image forming area) without reacting with the ink. In this apparatus, the liquid absorbing member 105*a* comes into contact (pressure contact) with not only the first image but also the unreacted reaction liquid, and the liquid component of the reaction liquid is also removed from the surface of the transfer body 101. Therefore, in the above description, it is expressed and described that the liquid component is removed from the first image, but this is not limited to the meaning that the liquid component is removed from only the first image, but means that a liquid component is removed from at least the first image on the transfer body. For example, it is also possible to remove the liquid component in the reaction liquid applied to the outer region of the first image together with the first image.

Note that, the liquid component is not particularly limited as long as it does not have a certain shape, has fluidity, and has a substantially constant volume. For example, water, an organic solvent, or the like contained in the ink and the reaction liquid is exemplified as a liquid component.

Also, even in a case where the clear ink is contained in the first image, it is possible to concentrate the ink by the liquid absorption treatment. For example, when the clear ink is applied onto the color ink containing the coloring material applied onto the transfer body 101, the clear ink is present on the entire surface of the first image, or the clear ink is partially present at one or more places on the surface of the first image, and the color ink is present in other places.

In the first image, in the places where the clear ink is present on the color ink, the porous body absorbs the liquid component of the clear ink on the surface of the first image and the liquid component of the clear ink moves. Accordingly, the liquid component in the color ink moves to the porous body side, and thereby the aqueous liquid component in the color ink is absorbed. On the other hand, in the places where a region of the clear ink and a region of the color ink are present on the surface of the first image, the respective liquid components of the color ink and the clear ink move to the porous body side, and thereby the liquid components are absorbed. Note that, the clear ink may contain a large amount of components for improving transferability of the image from the transfer body 101 to the recording medium 108. For example, the content of the component that increases the adhesiveness to the recording medium by heating may be higher than that of the color ink.

Each configuration of the transfer type ink jet recording apparatus of this embodiment will be described below.

(Transfer Body)

A transfer body 101 includes a surface layer including an image forming surface. As a member of the surface layer, various materials such as a resin and ceramics can be appropriately used, but from the viewpoint of durability and the like, a material having high compressive elastic modulus is preferable. Specifically, examples thereof include a condensate obtained by condensing an acrylic resin, an acrylic silicone resin, a fluorine-containing resin, and a hydrolyzable organosilicon compound. In order to improve the wettability and the transferability of the reaction liquid, the surface treatment may be performed before use. Examples of the surface treatment include a frame treatment, a corona treatment, a plasma treatment, a polishing treatment, a roughening treatment, an active energy ray irradiation treatment, an ozone treatment, a surfactant treatment, and a silane coupling treatment. These may be combined in plural. An optional surface shape can also be provided on the surface layer.

Further, it is preferable that the transfer body includes a compressible layer having a function of absorbing pressure variation. When the compressible layer is provided, the compressible layer absorbs the deformation, disperses the variation against local pressure variation, and maintains excellent transferability even during high-speed printing. Examples of members of the compressible layer include acrylonitrile-butadiene rubber, acrylic rubber, chloroprene rubber, urethane rubber, and silicone rubber.

It is preferable that at the time of molding the rubber material, a predetermined amount of a vulcanizing agent, a vulcanization accelerator and the like are blended and a filler such as a foaming agent, a hollow fine particle or salt is further blended, as necessary, to make the rubber material porous. As a result, a bubble portion is compressed with volume change for various pressure fluctuations, so that deformation in a direction other than the compression direction is small and a more stable transferability and the durability can be obtained. As the porous rubber material, there are one having continuous pore structure in which the pores are continuous to each other and one having independent pore structure in which the pores are independently separated from each other. In the present invention, any structure may be used, and these structures may be used in combination.

Further, the transfer body preferably includes an elastic layer between the surface layer and the compressible layer. As a member of the elastic layer, various materials such as resin, ceramics and the like can be appropriately used. Various elastomer materials and rubber materials are preferably used from the viewpoint of processing characteristics and the like. Specific examples thereof include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. In particular, silicone rubber, fluorosilicone rubber, and phenyl silicone rubber are preferable in terms of dimensional stability and the durability because of small compression set. In addition, the change in the elastic modulus due to temperature is small, which is also preferable from the viewpoint of transferability.

Various adhesives or double-sided tapes may be used between the layers constituting the transfer body (the surface layer, the elastic layer, and the compressible layer) in order to fix and hold the layers. A reinforcing layer having a high compressive elastic modulus may be provided for suppressing lateral elongation when being mounted on the device and for maintaining elasticity. Further, the woven fabric may be used as a reinforcing layer. The transfer body can be produced by optionally combining each layer by the above-described material.

The size of the transfer body can be freely selected according to the size of the target print image. The shape of the transfer body is not particularly limited, and specifically, examples thereof include a sheet shape, a roller shape, a belt shape, and an endless web shape.

(Support Member)

The transfer body 101 is supported on the support member 102. As a method of supporting the transfer body, various adhesives or double-sided tapes may be used. Alternatively, by attaching a mounting member made of a material such as metal, ceramic, and a resin to the transfer body, the transfer body may be supported on the support member 102 using the mounting member.

The support member 102 is required to have a certain degree of structural strength from the viewpoint of conveying accuracy and durability. For the material of the support member, metal, ceramic, resin, or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, alumina ceramics are preferably used. Further, these are preferably used in combination.

(Reaction Liquid Applying Device)

The ink jet recording apparatus of the present embodiment includes the reaction liquid applying device 103 for applying the reaction liquid to the transfer body 101. The reaction liquid applying device 103 illustrated in FIG. 1 indicates a gravure offset roller which is provided with reaction liquid storing unit 103*a* for storing the reaction liquid and a reaction liquid applying units 103*b* and 103*c* for applying the reaction liquid in the reaction liquid storing unit 103*a* onto the transfer body 101.

(Ink Applying Device)

The ink jet recording apparatus of the present embodiment includes an ink applying device 104 that applies ink to the transfer body 101 to which the reaction liquid is applied. The first image is formed by mixing the reaction liquid and the ink, and in the subsequent liquid absorbing device 105, the liquid component is absorbed from the first image.

(Liquid Absorbing Device)

In this embodiment, the liquid absorbing device 105 includes the liquid absorbing member 105*a*, and a pressing member 105*b* for liquid absorption which presses the liquid absorbing member 105*a* against the first image on the transfer body 101. Note that, the shapes of the liquid absorbing member 105*a* and pressing member 105*b* are not particularly limited. For example, as illustrated in FIG. 1, a configuration in which the pressing member 105*b* has a columnar shape, the liquid absorbing member 105*a* has a belt shape, and the liquid absorbing member 105*a* having the belt shape is pressed against the transfer body 101 by the pressing member 105*b* having the columnar shape may be employed. In addition, a configuration in which the pressing member 105*b* has a columnar shape, the liquid absorbing member 105*a* has a cylindrical shape formed on the peripheral surface of the pressing member 105*b* having the columnar shape, and the liquid absorbing member 105*a* having the cylindrical shape is pressed against the transfer body by the pressing member 105*b* having the columnar shape may be employed.

In the present invention, it is preferable that the liquid absorbing member 105*a* has the belt shape in consideration of the space and the like in the ink jet recording apparatus.

In addition, the liquid absorbing device 105 which includes the liquid absorbing member 105*a* having such a belt shape may include an extending member for extending the liquid absorbing member 105*a*. In FIG. 1, reference numerals 105*c*, 105*d*, and 105*e* represent an extending roller as the extending member. In FIG. 1, the pressing member 105*b* is also a roller member that rotates similarly to the extending roller, but the present invention is not limited thereto.

In the liquid absorbing device 105, when the liquid absorbing member 105*a* including the porous body is pressed to the first image by the pressing member 105*b*, the second image is obtained by absorbing the liquid component contained in the first image to the liquid absorbing member 105*a*, and decreasing the liquid component from the first image. As a method of decreasing the liquid components from the first image, in addition to the present method of pressing the liquid absorbing member, other various conventionally used methods, for example, a method of heating, a method of blowing low humidity air, and a method of reducing pressure may be used in combination. Alternatively, these methods may be applied to the second image with decreased liquid component to further decrease the liquid component.

Hereinafter, various conditions and configurations in the liquid absorbing device 105 will be described in detail.

(Pretreatment)

In the present embodiment, a pretreatment is preferably performed by pretreatment means (not shown in FIGS. 1 and 2) for applying a wetting liquid to the liquid absorbing member before bringing the liquid absorbing member 105*a* having the porous body into contact with the first image. The wetting liquid used in the present invention preferably contains water and a water-soluble organic solvent. Water is preferably deionized water by ion exchange or the like. Further, the kinds of the water-soluble organic solvents to be used are not particularly limited, and any of known organic solvents such as ethanol and isopropyl alcohol can be used. In the pretreatment of the liquid absorbing member used in the present invention, the method of applying the wetting liquid to the porous body is not particularly limited, and immersion and liquid droplet dripping are preferable.

The component for adjusting the surface tension of the wetting liquid is not particularly limited, but it is preferable to use a surfactant. As the surfactant, it is preferable to use at least one of a silicone-based surfactant and a fluorine-based surfactant, and is more preferable to use the fluorine-based surfactant. In addition, the content of the surfactant in the wetting liquid is preferably equal to or larger than 0.2% by mass, is more preferably equal to or larger than 0.4% by mass, and is particularly preferably equal to or larger than 0.5% by mass, with respect to the total mass of the wetting liquid. The upper limit of the content of the surfactant in the wetting liquid is not particularly limited, and is preferably 10% by mass with respect to the total mass of the wetting liquid from the viewpoint of solubility of the surfactant in the wetting liquid.

(Pressurizing Condition)

When the pressure of the liquid absorbing member pressing against the first image on the transfer body is equal to or greater than 2.9 $N/cm^2$ (0.3 $kgf/cm^2$), the liquid component in the first image can be solid-liquid separated in a shorter time period, and the liquid component can be removed from the first image, which is preferable. Further, when the pressure is equal to or lower than 98 $N/cm^2$ (10 $kgf/cm^2$), the structural load on the apparatus can be suppressed, which is preferable. Note that, in the present specification, the pressure of the liquid absorbing member indicates a nip pressure between the ink receiving medium and the liquid absorbing member, and the value is calculated by performing surface pressure measurement by using a surface pressure distribution measuring device (I-SCAN, manufactured by NITTA Corporation), and dividing the load in the pressurized region by the area.

(Application Time)

It is preferable that the application time of bringing the liquid absorbing member 105*a* into contact with the first image is within 50 ms (milliseconds) in order to further suppress the adhesion of the coloring material in the first image to the liquid absorbing member. Incidentally, the application time in the present specification is calculated by dividing a pressure sensing width in the moving direction of the ink receiving medium in the above-described surface pressure measurement by the moving speed of the ink receiving medium. Hereinafter, this application time is referred to as a liquid absorbing nip time.

In this way, on the transfer body 101, the liquid component is absorbed from the first image and a second image with reduced liquid content is formed. The second image is then transferred onto the recording medium 108 at the transfer unit. Device configuration and conditions at the time of transfer will be described.

(Pressing Member for Transferring)

In the present embodiment, while the second image and the recording medium 108 conveyed by the conveyance device 107 for the recording medium are in contact with each other, the pressing member 106 for transferring presses the recording medium 108, and thereby an ink image is transferred onto the recording medium 108. When removing the liquid component contained in the first image on the transfer body 101, and then transferring it onto the recording medium 108, it is possible to obtain a recorded image in which curling, cockling, and the like are suppressed.

The pressing member 106 is required to have a certain degree of structural strength from the viewpoint of conveying accuracy and durability of the recording medium 108. For the material of the pressing member 106, metal, ceramic, resin, or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, and alumina ceramics are preferably used. Further, these may be used in combination.

The pressing time of the pressing member 106 for transferring the second image on the transfer body 101 onto the recording medium 108 is not particularly limited, and in order not to impair the transferability and the durability of the transfer body, it is preferably 5 ms to 100 ms. In the present embodiment, the pressurizing time indicates the time during which the recording medium 108 and the transfer body 101 are in contact with each other, and the value of the time is calculated by performing the surface pressure measurement by using the surface pressure distribution measuring device (I-SCAN, manufactured by NITTA Corporation), and dividing the length in the conveying direction of the pressure region by the conveying speed.

The pressure pressed by the pressing member 106 for transferring the second image on the transfer body 101 onto the recording medium 108 is also not particularly limited as long as the transfer is performed well and the durability of the transfer body is not impaired. Therefore, it is preferable that the pressure is 9.8 N/cm$^2$ (1 kg/cm$^2$) to 294.2 N/cm$^2$ (30 kg/cm$^2$). Incidentally, the pressure in the present embodiment indicates the nip pressure between the recording medium 108 and the transfer body 101, and the value of the pressure is calculated by performing the surface pressure measurement by the surface pressure distribution measuring device, and dividing the load in the pressure region by the area.

The temperature at which the pressing member 106 presses for transferring the second image on the transfer body 101 onto the recording medium 108 is also not particularly limited, and it is preferably equal to or higher than a glass transition point or equal to or higher than a softening point of a resin component contained in the ink. For heating, it is preferable to provide heating means for heating a second image on the transfer body 101, the transfer body 101 and the recording medium 108.

The shape of the transfer means 106 is not particularly limited, but for example, a roller shape can be mentioned.

(Recording Medium and Conveyance Means for Recording Medium)

In the present embodiment, the recording medium 108 is not particularly limited, and any of known recording media can be used. As the recording medium, a long object wound in a roll shape or a sheet material cut into a predetermined size can be exemplified. Examples of the materials include paper, a plastic film, a wood board, a cardboard, and a metal film.

In FIG. 1, the conveyance device 107 for recording medium for conveying the recording medium 108 is constituted by a feeding roller 107*a* for recording medium and a winding roller 107*b* for recording medium, but it is not particularly limited thereto as long as the recording medium can be conveyed.

(Control System)

Figure 3:
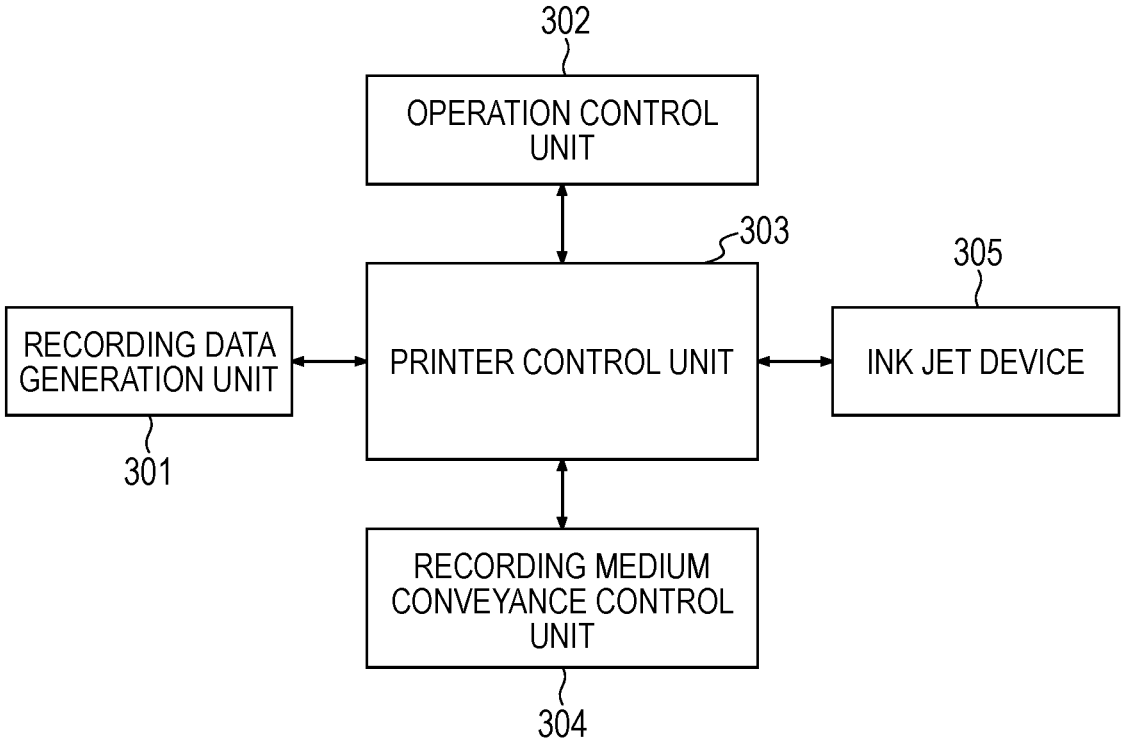
FIG. 3 is a block diagram illustrating a control system of the entire apparatus in the ink jet recording apparatus illustrated in FIGS. 1 and 2.

The direct transfer type ink jet recording apparatus in the present embodiment has a control system for controlling each device. FIG. 3 is a block diagram illustrating a control system of the entire apparatus in the transfer type ink jet recording apparatus illustrated in FIG. 1.

In FIG. 3, a reference numeral 301 represents a recording data generation unit such as an external print server, a reference numeral 302 represents an operation control unit such as an operation panel, a reference numeral 303 represents a printer control unit for executing a recording process, a reference numeral 304 represents a recording medium conveyance control unit for conveying the recording medium, and a reference numeral 305 represents an ink jet device for printing.

Figure 4:
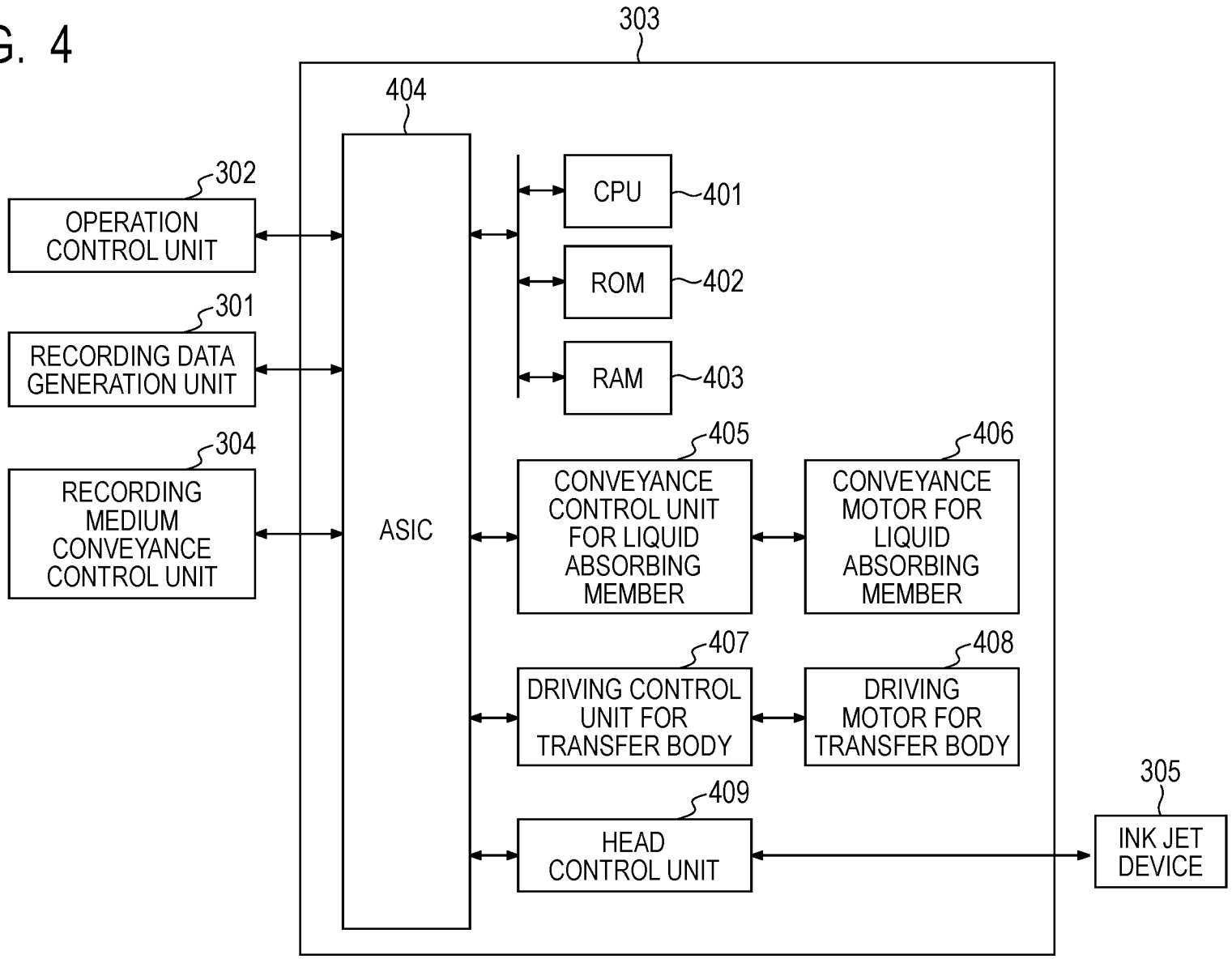
FIG. 4 is a block diagram of a printer control unit in the transfer type ink jet recording apparatus illustrated in FIG. 1.

FIG. 4 is a block diagram of a printer control unit in the transfer type ink jet recording apparatus illustrated in FIG. 1.

Reference numeral 401 represents a CPU for controlling the entire printer, a reference numeral 402 represents a ROM for storing a control program of the CPU, and a reference numeral 403 represents a RAM for executing the program. A reference numeral 404 represents an application specific integrated circuit (ASIC) including a network controller, a serial IF controller, a controller for generating head data, a motor controller, and the like. A reference numeral 405 represents a conveyance control unit for liquid absorbing member for driving a conveyance motor 406 for liquid absorbing member, and the conveyance control unit 405 for liquid absorbing member is controlled by a command from the ASIC 404 via the serial IF. A reference numeral 407 represents a driving control unit for transfer body that drives a driving motor 408 for transfer body, and similarly, the driving control unit 407 for transfer body is controlled by a command from the ASIC 404 via the serial IF. A reference numeral 409 represents a head control unit which performs final discharge data generation, drive voltage generation, and the like of the ink jet device 305.

<Direct Drawing Type Ink Jet Recording Apparatus>

As another embodiment of the present invention, a direct drawing type ink jet recording apparatus can be mentioned. In the direct drawing type ink jet recording apparatus, the ink receiving medium is a recording medium on which an image is to be formed.

Figure 2:
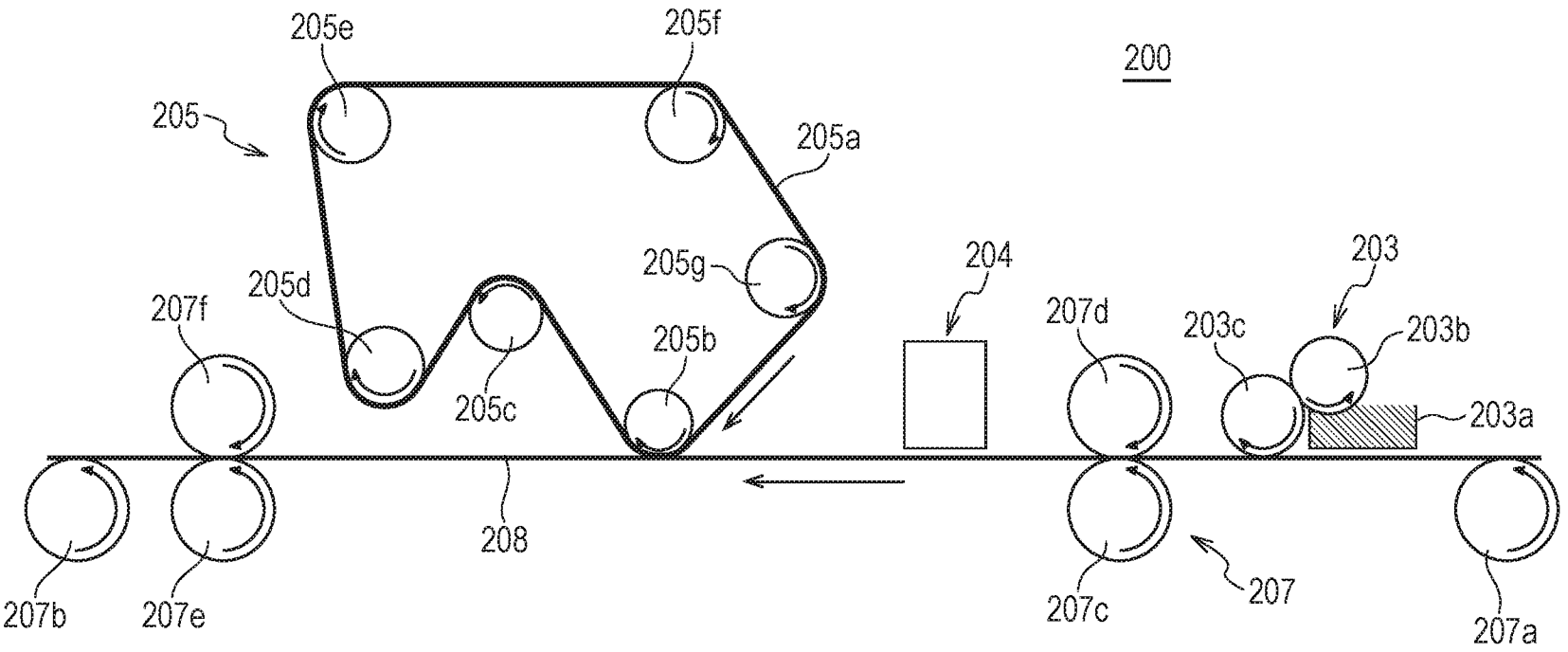
FIG. 2 is a schematic diagram illustrating one example of a configuration of a direct drawing type ink jet recording apparatus in one embodiment according to the present invention.

FIG. 2 is a schematic diagram illustrating one example of a schematic configuration of a direct drawing type ink jet recording apparatus 200 of the present embodiment. Compared to the transfer type ink jet recording apparatus described above, the direct drawing type ink jet recording apparatus has means similar to those of the transfer type ink jet recording apparatus except that it does not have the transfer body 101, the support member 102, and the cleaning means 109 for transfer body, and forms an image on a recording medium 208.

Therefore, by means of a reaction liquid applying device 203 for applying the reaction liquid to the recording medium 208, an ink applying device 204 for applying ink to the recording medium 208, and a liquid absorbing member 205*a* coming into contact with a first image on the recording medium 208, a liquid absorbing device 205 that absorbs the liquid component contained in the first image has the same configuration as that of the transfer type ink jet recording apparatus, and thus explanation thereof will not be described.

Note that, in the direct drawing type ink jet recording apparatus of the present embodiment, the liquid absorbing device 205 includes the liquid absorbing member 205*a*, and a pressing member 205*b* for liquid absorption which presses the liquid absorbing member 205*a* against the first image on the recording medium 208. The shapes of the liquid absorbing member 205*a* and the pressing member 205*b* are not particularly limited, and it is possible to use the same shapes as the liquid absorbing member and the pressing member that can be used in the transfer type ink jet recording apparatus. In addition, the liquid absorbing device 205 may include an extending member for extending the liquid absorbing member.

In FIG. 2, reference numerals 205*c*, 205*d*, 205*e*, 205*f*, and 205*g* represent an extending roller as the extending member. The number of the extending rollers is not limited to five as illustrated in FIG. 4, and a necessary number of the extending rollers may be arranged according to the apparatus design. A recording medium support member (not shown) for supporting the recording medium from below may be provided at a position facing an ink applying unit for applying ink to the recording medium 208 by the ink applying device 204 and a liquid component removing unit for pressing the liquid absorbing member 205*a* against the first image on the recording medium to remove the liquid component.

(Conveyance Device for Recording Medium)

In the direct drawing type ink jet recording apparatus of the present embodiment, a conveyance device for recording medium 207 is not particularly limited, and a conveyance means in a known direct drawing type ink jet recording apparatus can be used. Examples thereof include, as illustrated in FIG. 2, a conveyance device for recording medium including a feeding roller 207*a* for recording medium, a winding roller 207*b* for recording medium, and conveyance rollers 207*c*, 207*d*, 207*e*, and 207*f* for recording medium.

(Control System)

The direct drawing type ink jet recording apparatus in the present embodiment has a control system for controlling each device. The block diagram illustrating a control system of the entire apparatus in the direct drawing type ink jet recording apparatus illustrated in FIG. 2 is as illustrated in FIG. 3 similar to the transfer type ink jet recording apparatus illustrated in FIG. 1.

Figure 5:
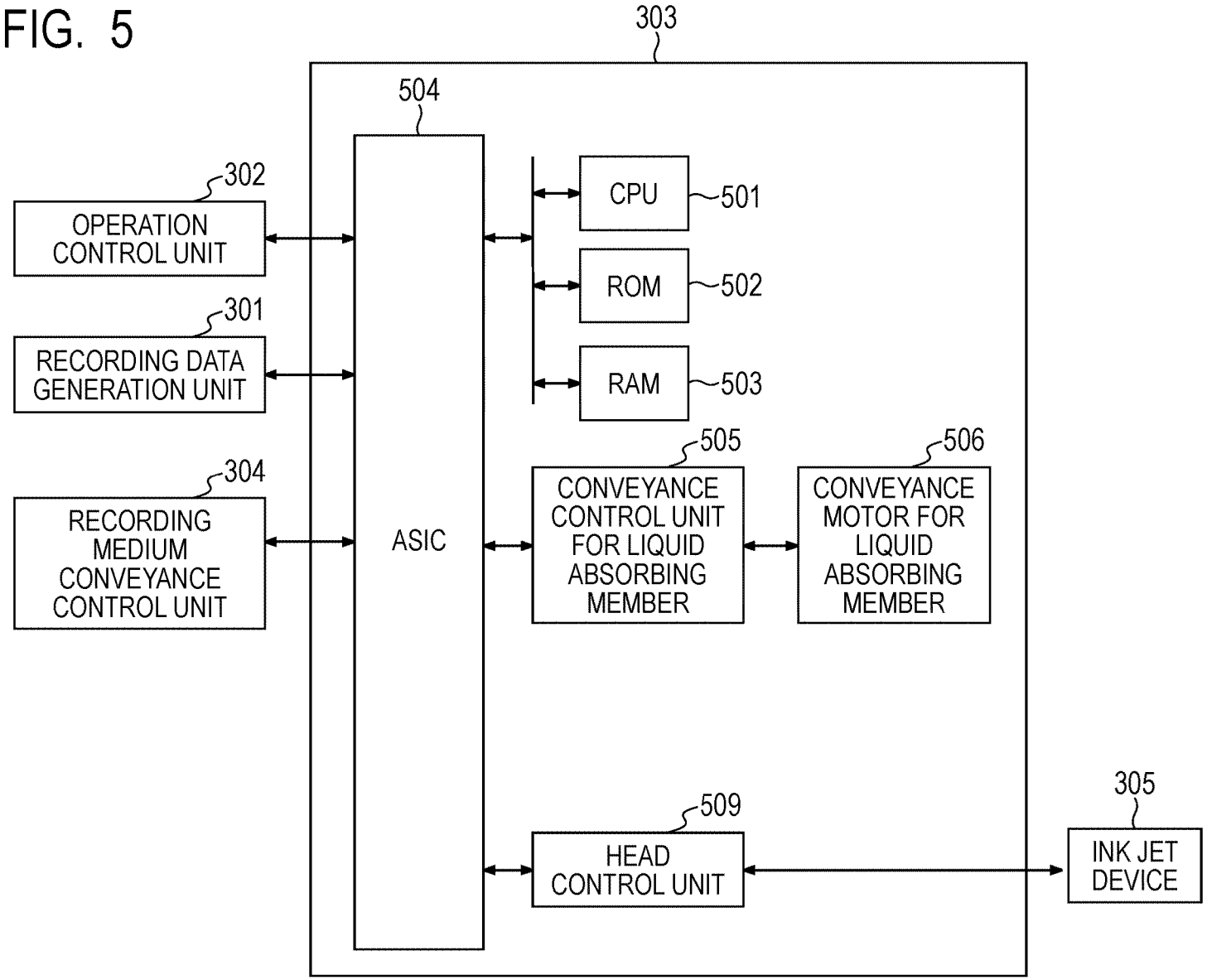
FIG. 5 is a block diagram of a printer control unit in the direct drawing type ink jet recording apparatus illustrated in FIG. 2.

FIG. 5 is a block diagram of a printer control unit in the direct drawing type ink jet recording apparatus illustrated in FIG. 2. Except for not including the driving control unit 407 for transfer body and the driving motor 408 for transfer body, FIG. 5 is the same block diagram as the block diagram of the printer control unit in the transfer type ink jet recording apparatus in FIG. 4.

In other words, reference numeral 501 represents a CPU for controlling the entire printer, a reference numeral 502 represents a ROM for storing a control program of the CPU, and a reference numeral 503 represents a RAM for executing the program. A reference numeral 504 represents an ASIC including a network controller, a serial IF controller, a controller for generating head data, a motor controller, and the like. A reference numeral 505 represents a conveyance control unit for liquid absorbing member for driving a conveyance motor for liquid absorbing member 506, and the conveyance control unit for liquid absorbing member 505 is controlled by a command from the ASIC 504 via the serial IF. A reference numeral 509 represents a head control unit which performs final discharge data generation, drive voltage generation, and the like of the ink jet device 305.

Examples

Hereinafter, the present invention will be more specifically described with reference to examples and comparative examples. The present invention is not limited by the following examples without departing from the gist thereof. In the description of the following examples, "part" is on a mass basis unless otherwise specified.

<Preparing of Reaction Liquid>

For the reaction liquid, a reaction liquid having the composition indicated below was used. Note that, the "remainder" of the ion exchanged water is an amount such that the total of all components constituting the reaction liquid is 100.0% by mass.

Glutaric acid: 21.0% by mass

Glycerin: 5.0% by mass

Surfactant (product name: Megafac F444, manufactured by DIC Corporation): 5.0% by mass Ion exchanged water: remainder <Preparing of Pigment Dispersion>

10 parts of carbon black (product name: Monarch 1100, manufactured by Cabot Corporation), 15 parts of aqueous resin solution (obtained by neutralizing a styrene-ethyl acrylate-acrylic acid copolymer and an aqueous solution having an acid value of 150, a weight average molecular weight (Mw) of 8,000, and a resin content of 20.0% by mass with an aqueous potassium hydroxide solution), and 75 parts of pure water were mixed. The mixture was charged into a batch type vertical sand mill (manufactured by AIMEX CO., Ltd.), the batch type vertical sand mill was filled with 200 parts of zirconia beads having a diameter of 0.3 mm, and a dispersion treatment was performed for five hours while cooling with water. When the dispersion was centrifuged to remove coarse particles, a pigment dispersion having a pigment content of 10.0% by mass was obtained.

<Preparing of Resin Fine Particle Dispersion>

20 parts of ethyl methacrylate, 3 parts of 2,2'-azobis-(2-methyl butyronitrile), and 2 parts of n-hexadecane were mixed and stirred for 0.5 hours. This mixture was added dropwise to 75 parts of an 8% by mass of aqueous solution of a styrene-butyl acrylate-acrylic acid copolymer (acid value: 130 mgKOH/g, weight average molecular weight (Mw): 7,000), and stirred for 0.5 hours. Next, ultrasonic waves were irradiated by an ultrasonic irradiator for three hours. Subsequently, a polymerization reaction was performed at 80° C. for four hours in a nitrogen atmosphere, and after cooling at room temperature, filtration was performed so as to prepare a resin fine particle dispersion having a resin content of 25.0% by mass.

<Preparing of Ink>

The pigment dispersion and the resin fine particle dispersion were mixed with each of the following components. Note that, the "remainder" of the ion exchanged water is an amount such that the total of all components constituting the ink is 100.0% by mass.

Pigment dispersion: 40.0% by mass

Resin fine particle dispersion: 20.0% by mass

Glycerin: 7.0% by mass

Polyethylene glycol (number average molecular weight (Mn): 1,000): 3.0% by mass

Surfactant: acetylenol E100 (product name, manufactured by Kawaken Fine Chemicals Co., Ltd.): 0.5% by mass Ion exchanged water: remainder After sufficiently stirring and dispersing the mixture, pressure filtration was performed with a microfilter (manufactured by FUJIFILM Corporation) having a pore diameter of 3.0 μm so as to prepare ink.

<Preparing Porous Body>

As the first layer, a layer having a thickness, an average pore diameter of a surface, an average pore diameter of a back surface, and a surface Ra, indicated in the following Table 1 was prepared. Note that, Table 1 also indicates the presence or absence of change in the average pore diameter and the presence or absence of change in the material concentration.

1-a, b, e, f, g, h and l are stretched films made of polytetrafluoroethylene (PTFE). These were prepared by compression molding of highly-crystallized PTFE emulsion polymerized particles and stretching at a temperature equal to or lower than the melting point so as to obtain a fibrillated porous body. In addition, 1-c, i, j and k are films made of polyethylene terephthalate (PET). These were prepared by applying a voltage between the nozzle and the electrode and laminating the molten solution, and then performing hot-pressing, using an electrospinning method. In 1-d, the front surface side was made of polyvinylidene fluoride (PVDF) and the back surface side was made of polyethylene terephthalate (PET), and the material concentration was varied by changing the volume ratio of these materials in the first layer. In 1-c, d, i and j, the fiber diameter was changed by changing the distance between the nozzle and the electrode using the electrospinning method. With this, from the front surface to the back surface, the average pore diameter was changed from 0.20 μm to 20.00 μm in 1-c, d, and j, and from 0.50 μm to 20.00 μm in 1-i, respectively.

TABLE 1

| First layer | Material | Thickness (μm) | Surface average pore diameter (μm) | Back surface average pore diameter (μm) | Surface Ra (μm) | Change of average pore diameter | Change of material concentration |
|---|---|---|---|---|---|---|---|
| 1-a | PTFE | 35 | 0.50 | 0.50 | 1.5 | Unchanged | Unchanged |
| 1-b | PTFE | 20 | 0.50 | 0.50 | 1.5 | Unchanged | Unchanged |
| 1-c | PET | 50 | 0.50 | 20.00 | 1.7 | Changed | Unchanged |
| 1-d | PVDF/PET | 50 | 0.50 | 20.00 | 1.7 | Changed | Changed |
| 1-e | PTFE | 25 | 1.00 | 1.00 | 2.3 | Unchanged | Unchanged |
| 1-f | PTFE | 25 | 0.50 | 0.50 | 2.5 | Unchanged | Unchanged |
| 1-g | PTFE | 25 | 0.10 | 0.10 | 1.5 | Unchanged | Unchanged |
| 1-h | PTFE | 50 | 0.50 | 0.50 | 1.0 | Unchanged | Unchanged |
| 1-i | PET | 50 | 1.00 | 20.00 | 2.3 | Changed | Unchanged |
| 1-j | PET | 50 | 0.50 | 20.00 | 2.5 | Changed | Unchanged |
| 1-k | PET | 70 | 0.50 | 0.50 | 1.7 | Unchanged | Unchanged |
| 1-l | PTFE | 35 | 0.50 | 0.50 | 1.3 | Unchanged | Unchanged |

As the second layer, a layer having a thickness, a surface Ra, an average pore diameter of a surface, an average pore diameter of a back surface, and an average interval of the local peak, indicated in the following Table 2 was prepared. 2-a, b, c, and d are films made of polyethylene which is a first fiber. These were prepared by compression molding of crystallized polyethylene emulsion polymerized particles and stretching at a temperature equal to or lower than the melting point so as to obtain a fibrillated porous body. In addition, 2-e and f are films made of polyethylene which is the first fiber and polypropylene which is the second fiber. These were produced by a wet method while mixing materials formed of two kinds of single fibers.

TABLE 2

| | Physical value | | | | | Constituent material | | | | |
|---|---|---|---|---|---|---|---|---|---|---|
| | | | | | | First fiber | | Second fiber | | Constitutive ratio |
| Second layer | Thickness (μm) | Surface Ra (μm) | Surface average pore diameter (μm) | Back surface average pore diameter (μm) | Average interval of the local peak (μm) | Average fiber diameter (μm) | Softening point (° C.) | Average fiber diameter (μm) | Softening point (° C.) | (Mass ratio) (First fiber:Second fiber) |
| 2-a | 150 | 10.0 | 6.00 | 6.00 | 20 | 5.0 | 100 | — | — | — |
| 2-b | 50 | 10.0 | 6.00 | 6.00 | 20 | 5.0 | 100 | — | — | — |
| 2-c | 50 | 3.5 | 4.00 | 4.00 | 20 | 5.0 | 100 | — | — | — |
| 2-d | 150 | 10.0 | 0.50 | 0.50 | 1 | 5.0 | 100 | — | — | — |
| 2-e | 50 | 10.0 | 6.00 | 6.00 | 20 | 5.0 | 100 | 0.3 | 160 | 1:1 |
| 2-f | 50 | 3.5 | 4.00 | 4.00 | 20 | 5.0 | 100 | 0.3 | 160 | 1:1 |

As the second layer, a layer (2-g) having a thickness, a surface Ra, an average pore diameter of a surface, an average pore diameter of a back surface, an average interval of the local peak, and an average fiber diameter, indicated in the following Table 3 was prepared. 2-g is a film made of fibers containing polyethylene (PE) as a first material and polypropylene (PP) as a second material at a mass ratio of 1:1. The first material is a "sheath structure", and the second material is a "core structure", and thus the first material and the second material have a "core-sheath structure". 2-g was produced by a wet method using fibers having a core-sheath structure.

TABLE 3

| | Physical value | | | | | | Constituent material | | |
|---|---|---|---|---|---|---|---|---|---|
| | | | | | | | First material | Second material | Constitutive ratio |
| Second layer | Thickness (μm) | Surface Ra (μm) | Surface average pore diameter (μm) | Back surface average pore diameter (μm) | Average interval of the local peak (μm) | Average fiber diameter (μm) | (PE) Softening point (° C.) | (PP) Softening point (° C.) | (Mass ratio) (First material:Second material) |
| 2-g | 50 | 3.5 | 4.00 | 4.00 | 20 | 5.0 | 100 | 160 | 1:1 |

As the third layer which is the support layer, a film made of each material having a thickness, an average pore diameter of a surface, and an average pore diameter of a back surface, indicated in the following Table 4 was prepared. 3-a and 3-b were produced by a wet method using a material formed of a single fiber. As the material of 3-b, fibers having a "sheath structure" for polyethylene (PE) and the "core structure" for polypropylene (PP) to be "core-sheathstructure" were used.

TABLE 4

| Third layer | Thickness (μm) | Surface average pore diameter (μm) | Back surface average pore diameter (μm) | Material |
|---|---|---|---|---|
| 3-a | 150 | 36.00 | 36.00 | PET fiber |
| 3-b | 150 | 36.00 | 36.00 | PE/PP Fiber having core-sheath structure |

In accordance to the combination indicated in the following Table 5, if necessary, the first layer, the second layer, and the third layer were laminated by the lamination by hot pressure so as to obtain a porous body used in examples and comparative examples. Further, the plastic deformation starting load and the Gurley value per unit width of the obtained porous body were measured by the above method. The results are indicated in Table 5. Note that, the arithmetic average roughness Ra of the first surface to be in contact with the first image of the obtained porous body was the same as the arithmetic average roughness Ra of the surface of the first layer before lamination.

<Ink Jet Recording Apparatus and Image Formation>

The transfer type ink jet recording apparatus illustrated in FIG. 1 was used. The transfer body 101 was fixed to the surface of the support member 102 by double-sided tape. A coated sheet obtained by coating a PET sheet having a thickness of 0.5 mm with silicone rubber (KE12 (product name), manufactured by Shin-Etsu Chemical Co., Ltd.) by a thickness of 0.3 mm was used as an elastic layer of the transfer body 101. Further, a mixture of a condensate obtained by mixing glycidoxypropyl triethoxy silane and methyl triethoxy silane at a molar ratio of 1:1 and heating it under reflux, and a photo cationic polymerization initiator (SP 150 (product name), manufactured by ADEKA) was prepared. An atmospheric pressure plasma treatment was performed on the elastic layer surface so that the contact angle of water on the surface of the elastic layer is equal to or smaller than 10 degrees. Thereafter, the mixture was applied onto the elastic layer, and the mixture was formed into a film by UV irradiation (high pressure mercury lamp, integrated exposure amount 5,000 mJ/cm$^2$) and thermal curing (150° C. for two hours) so as to form a transfer body 101 in which a surface layer having a thickness of 0.5 μm was formed on the elastic layer. Note that, the surface of the transfer body 101 was kept at 60° C. by heating means (not shown).

The applying amount of the reaction liquid by the reaction liquid applying device 103 was set to be 1 g/m$^2$. As the ink applying device 104, an ink jet recording head of the type which discharges ink by an on-demand method using an electro-thermal converter was used, and a solid image was formed on the transfer body. The applying amount of the ink at the time of image formation was set to 10 g/m$^2$.

TABLE 5

| Example No. / Comparative Example No. | Layer configuration: First layer | Second layer | Third layer | Surface (first surface) average pore diameter (μm) | Back surface (second surface) average pore diameter (μm) | Plastic deformation starting load (N/m) | Gurley value (Seconds) |
|---|---|---|---|---|---|---|---|
| Example 1 | 1-a | 2-a | — | 0.20 | 6.00 | 200 | 7.0 |
| Example 2 | 1-b | 2-b | — | 0.20 | 6.00 | 200 | 4.0 |
| Example 3 | 1-b | 2-c | 3-a | 0.20 | 36.00 | 400 | 4.0 |
| Example 4 | 1-b | 2-e | — | 0.20 | 6.00 | 200 | 3.0 |
| Example 5 | 1-b | 2-f | 3-a | 0.20 | 36.00 | 400 | 3.0 |
| Example 6 | 1-b | 2-g | — | 0.20 | 4.00 | 200 | 3.0 |
| Example 7 | 1-c | — | — | 0.20 | 20.00 | 200 | 7.0 |
| Example 8 | 1-d | — | — | 0.20 | 20.00 | 200 | 7.0 |
| Example 9 | 1-c | — | 3-a | 0.20 | 36.00 | 400 | 8.0 |
| Example 10 | 1-d | — | 3-a | 0.20 | 36.00 | 400 | 8.0 |
| Example 11 | 1-d | — | 3-b | 0.20 | 36.00 | 400 | 7.0 |
| Example 12 | 1-l | 2-a | — | 0.15 | 6.00 | 200 | 9.0 |
| Comparative Example 1 | 1-e | 2-a | — | 0.50 | 6.00 | 200 | 5.0 |
| Comparative Example 2 | 1-f | 2-a | — | 0.20 | 6.00 | 200 | 4.0 |
| Comparative Example 3 | 1-g | 2-a | — | 0.05 | 6.00 | 200 | 20.0 |
| Comparative Example 4 | 1-h | 2-a | — | 0.20 | 6.00 | 200 | 12.0 |
| Comparative Example 5 | 1-a | 2-d | — | 0.20 | 0.40 | 200 | 13.0 |
| Comparative Example 6 | 1-i | — | — | 0.50 | 20.00 | 200 | 6.0 |
| Comparative Example 7 | 1-j | — | — | 0.20 | 20.00 | 200 | 7.0 |
| Comparative Example 8 | 1-k | — | — | 0.20 | 0.20 | 200 | 13.0 |

The liquid absorbing member 105*a* includes the porous body on the side to be in contact with the first image. Before use, the liquid absorbing member 105*a* was immersed in a wetting liquid formed of 95 parts of ethanol and 5 parts of water to be permeated with the wetting liquid, and then the wetting liquid was substituted with water. In addition, the pressure is applied by the pressing member 105*b* so that the average nip pressure between the transfer body 101 and the liquid absorbing member 105*a* was set to be 2 kg/cm$^2$. The diameter of the pressing member 105*b* was 200 mm. In addition, at least a portion of the aqueous liquid component absorbed by the porous body by being into contact with the first image was removed from the porous body before being in contact with the first image again.

The conveyance speed of the liquid absorbing member 105*a* was adjusted by extending rollers 105*c*, 105*d*, and 105*e* which extend and convey the liquid absorbing member 105*a* such that the speed was the same as the moving speed of the transfer body 101. Further, in order that a speed of the recording medium 108 became equal to the moving speed of the transfer body 101, the recording medium 108 was conveyed by the feeding roller 107*a* for recording medium and the winding roller 107*b* for recording medium. The conveyance speed of the recording medium 108 was set to be 0.2 m/s. As the recording medium 108, Aurora coated paper (manufactured by Nippon Paper Industries Co., Ltd., basis weight 104 g/m$^2$) was used.

[Evaluation]

Evaluation of the ink jet recording apparatus in examples and comparative examples was carried out by the following evaluation method. The evaluation results are indicated in Table 6. In the present invention, the evaluation criteria AA to B of each of the evaluation items below were taken as preferable levels, and C was made unacceptable level.

<Adhesion of Coloring Material>

The extent of adhesion of the coloring material to the liquid absorbing member 105*a* after the liquid absorbing member 105*a* was brought into contact with the first image in image formation was observed. Evaluation criteria are described below.

AA: No adhesion of coloring material was observed even when repeatedly used (contacting the porous body of the liquid absorbing member with the image 10 times)

A: No adhesion of coloring material was observed in one use

B: Although slight adhesion of coloring material was observed by one use, it was a degree which does not matter C: Adhesion of coloring material was frequently observed by one use <Smeared Image>

In the image formation, the movement amount of the coloring material at the end of the image after the first liquid was absorbed, that is, the smeared image was observed. Evaluation criteria are described below.

AA: No smeared image was observed even when repeatedly used (contacting the porous body of the liquid absorbing member with the image 10 times)

A: Although smeared image was slightly observed only in a case of repeating use (contacting the porous body of the liquid absorbing member with the image 10 times), it was a degree which does not matter B: Although smeared image was slightly observed due to one liquid removal, it was a degree which does not matter C: Smeared image was frequently observed large due to one liquid removal.

<Conveyance Strength>

In the image formation, the presence or absence of deformation due to the tension applied at the time of conveyance of the liquid absorbing member 105*a* was observed. Evaluation criteria are described below.

A: Plastic deformation was not observed, and no plastic deformation was observed even when a stronger tension was applied at the time of high-speed conveyance.

B: Plastic deformation was not observed

C: Plastic deformation was observed

TABLE 6

| Example No. Comparative Example No. | Evaluation results: Adhesion of coloring material | Smeared image | Conveyance strength |
|---|---|---|---|
| Example 1 | B | B | B |
| Example 2 | B | A | B |
| Example 3 | AA | A | A |
| Example 4 | A | AA | B |
| Example 5 | AA | AA | A |
| Example 6 | AA | AA | B |
| Example 7 | B | B | B |
| Example 8 | A | B | B |
| Example 9 | B | B | A |
| Example 10 | A | B | A |
| Example 11 | A | B | A |
| Example 12 | A | B | B |
| Comparative Example 1 | C | A | B |
| Comparative Example 2 | C | A | B |
| Comparative Example 3 | A | C | B |
| Comparative Example 4 | A | C | B |
| Comparative Example 5 | A | C | B |
| Comparative Example 6 | C | B | B |
| Comparative Example 7 | C | B | B |
| Comparative Example 8 | B | C | B |

Additionally, the same test was conducted by using the direct drawing type ink jet recording apparatus illustrated in FIG. 2. In the image formation by the direct drawing type ink jet recording apparatus illustrated in FIG. 2, Gloria Pure White paper (manufactured by Gojo Paper MFG. CO. Ltd, basis weight of 210 g/m$^2$) was used as a recording medium 208. The reaction liquid, the reaction liquid applying device 203, the ink, the ink applying device 204, the conveyance speed of the recording medium 208, and the liquid absorbing device 205, except for the recording medium 208, were similar to those of the transfer type ink jet recording apparatus in Example 1, and the same evaluation as that of Example 1 was carried out. As a result, it was confirmed that the same evaluation results as those of Example 1 can be obtained.

According to the present invention, it is possible to provide an ink jet recording apparatus which is capable of suppressing adhesion of a coloring material and a smeared image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet recording apparatus comprising:

an image forming unit that forms a first image including a first liquid and a coloring material on an ink receiving medium; and a liquid absorbing member that includes a porous body which is configured to be brought into contact with the first image so as to absorb at least a portion of the first liquid from the first image, wherein an average pore diameter of a first surface of the porous body which is configured to be brought into contact with the first image is equal to or smaller than 0.6 μm, wherein an arithmetic average roughness Ra defined by JIS B 0601:2001 of the first surface of the porous body is equal to or smaller than 1.9 μm, wherein an average pore diameter of a second surface, which is a back surface of the first surface, of the porous body is larger than the average pore diameter of the first surface, and wherein a Gurley value defined by JIS P 8117 of the porous body is equal to or shorter than 10 seconds.

2. The ink jet recording apparatus according to claim 1, wherein the porous body includes a first layer which is configured to be brought into contact with the first image, and a second layer, wherein an average pore diameter of a first surface of the first layer which is configured to be brought into contact with the first image is equal to or smaller than 0.6 μm, wherein a thickness of the first layer is equal to or smaller than 35 μm, and wherein an average interval of a local peak defined by JIS B 0601:1994 in the first surface of the second layer on a side of the first layer is 3 μm to 40 μm.

3. The ink jet recording apparatus according to claim 2, wherein an arithmetic average roughness Ra defined by JIS B 0601:2001 of the first surface of the second layer is equal to or smaller than 10 μm.

4. The ink jet recording apparatus according to claim 2, wherein the second layer contains a first fiber and a second fiber, wherein an average fiber diameter of the first fiber is 0.1 μm to 15.0 μm, wherein an average fiber diameter of the second fiber is 0.1 μm to 15.0 μm, wherein the first fiber and the second fiber satisfy at least one of Condition (1) and Condition (2), Condition (1): the average fiber diameter of the first fiber is 1.2 times to 50.0 times with respect to the average fiber diameter of the second fiber, Condition (2): an absolute value of a difference between a softening point of the first fiber and a softening point of the second fiber is equal to or higher than 10° C., and wherein a mass ratio (first fiber:second fiber) of the first fiber to the second fiber contained in the second layer is 20:80 to 80:20.

5. The ink jet recording apparatus according to claim 2, wherein the second layer contains a fiber containing a first material and a second material, wherein an average fiber diameter of the fiber is 0.1 μm to 15.0 μm, wherein an absolute value of a difference between a softening point of the first material and a softening point of the second material is equal to or higher than 10° C., and wherein a mass ratio (first material:second material) of the first material to the second material contained in the second layer is 20:80 to 80:20.

6. The ink jet recording apparatus according to claim 1, wherein an average pore diameter changes in at least a partial region of the porous body in a thickness direction.

7. The ink jet recording apparatus according to claim 6, wherein a material concentration changes in at least a partial region of the porous body in the thickness direction.

8. The ink jet recording apparatus according to claim 1, wherein a plastic deformation starting load per unit width of the porous body is equal to or greater than 200 N/m.

9. The ink jet recording apparatus according to claim 1, wherein the porous body includes a third layer as a support layer.

10. The ink jet recording apparatus according to claim 9, wherein the third layer contains a fiber having a core-sheath structure.

11. The ink jet recording apparatus according to claim 1, wherein the image forming unit includes a device for applying a first liquid composition containing the first liquid or a second liquid, and an ink viscosity-increasing component onto the ink receiving medium, and a device for applying a second liquid composition containing the first liquid or the second liquid, and the coloring material onto the ink receiving medium, and wherein the first image is a mixture of the first and second liquid compositions and is viscously thickened more than the first and second liquid compositions.

12. The ink jet recording apparatus according to claim 1, wherein the ink receiving medium is a transfer body for temporarily holding the first image and a second image obtained by absorbing the first liquid from the first image, and wherein the apparatus further comprising:

a transfer unit including a pressing member for transferring the second image onto a recording medium on which an image is to be formed.

13. The ink jet recording apparatus according to claim 1, wherein the ink receiving medium is a recording medium on which an image is to be formed.

14. An ink jet recording apparatus comprising:

an image forming unit that forms a first image on an ink receiving medium by applying ink containing a first liquid and a coloring material to the ink receiving medium; and a liquid absorbing member including a porous body which is configured to be brought into contact with the first image so as to concentrate ink constituting the first image, wherein an average pore diameter of a first surface of the porous body which is configured to be brought into contact with the first image is equal to or smaller than 0.6 μm, wherein an arithmetic average roughness Ra defined by JIS B 0601:2001 of the first surface of the porous body is equal to or smaller than 1.9 μm, wherein an average pore diameter of a second surface, which is a back surface of the first surface, of the porous body is larger than the average pore diameter of the first surface, and wherein a Gurley value defined by JIS P 8117 of the porous body is equal to or shorter than 10 seconds.

* * * * *